US007622668B1

(12) United States Patent
Tollefson et al.

(10) Patent No.: US 7,622,668 B1
(45) Date of Patent: Nov. 24, 2009

(54) WILDLIFE PROTECTION GUARD FOR ELECTRICAL POWER DISTRIBUTION EQUIPMENT

(75) Inventors: Steve Tollefson, Mineral Wells, TX (US); John Morgan, Mineral Wells, TX (US)

(73) Assignee: Cantex, Inc., Fort Worth, TX (US)

( * ) Notice: Subject to any disclaimer, the term of this patent is extended or adjusted under 35 U.S.C. 154(b) by 12 days.

(21) Appl. No.: 12/114,244

(22) Filed: May 2, 2008

(51) Int. Cl.
*H01B 17/58* (2006.01)

(52) U.S. Cl. ..... 174/5 R; 174/138 F; 174/138 E; 174/139; 174/135; 174/140 H; 49/58; 52/101; 29/592; 340/584

(58) Field of Classification Search ..... 174/5 R, 174/5 SB, 138 E, 138 F, 139, 140 R, 136, 174/135, 140 H, 140 C; 49/58, 59; 361/232, 361/604, 618; 52/101; 29/592; 340/584; D13/118
See application file for complete search history.

(56) References Cited

U.S. PATENT DOCUMENTS

| | | | | |
|---|---|---|---|---|
| 1,177,867 | A | 4/1916 | Johnson | |
| 2,834,829 | A | 5/1958 | Broverman | |
| 2,875,267 | A | 2/1959 | Sutton | |
| 3,042,736 | A | 7/1962 | Salisbury | |
| 3,223,776 | A | 12/1965 | Piasecki | |
| 3,274,526 | A | 9/1966 | Emanuelson | |
| 3,484,541 | A | 12/1969 | Campbell | |
| 3,846,725 | A | 11/1974 | Mears, Jr. | |
| 4,845,307 | A | 7/1989 | Cumming | |
| 4,985,599 | A | 1/1991 | Eggleston | |
| 5,153,383 | A | 10/1992 | Whited et al. | |
| 5,293,721 | A | 3/1994 | Richard et al. | |
| D357,458 | S | 4/1995 | Tisbo | |
| 5,650,594 | A | 7/1997 | Urnovitz | |
| 5,864,096 | A * | 1/1999 | Williams et al. | 174/139 |
| 6,005,196 | A | 12/1999 | Spillyards | |

(Continued)

FOREIGN PATENT DOCUMENTS

| | | | |
|---|---|---|---|
| GB | 2 202 692 | A | 9/1988 |

OTHER PUBLICATIONS

Critter Guard, Inc. Critter Guard. The Solution to Squirrel Caused Power Outages [online]. [retrieved on Jan. 2, 2008]; Retrieved from the internet: <URL: http://www.critterguard.org/product .htm>.

(Continued)

*Primary Examiner*—Dhiru R Patel
(74) *Attorney, Agent, or Firm*—Miles & Stockbridge P.C.

(57) ABSTRACT

A wildlife protection guard for electrical power distribution equipment has an enclosure constructed to surround a power line connection and formed by a pair of half-shells. The enclosure has a base member, a sidewall extending from the base member, a tapered member extending from the sidewall, and a top member on the tapered member. The base member has a central opening with a plurality of flexible fingers. The top member has a central opening which defines a first port. A second opening is provided on the tapered sidewall to define a second port. The pair of half-shells is configured to be held in a closed configuration by a first latch on the sidewall and a second latch provided on a portion of the enclosure different from the sidewall. The pair of half-shells is connected together by a robust hinge configuration.

21 Claims, 9 Drawing Sheets

U.S. PATENT DOCUMENTS

| | | | | |
|---|---|---|---|---|
| 6,255,597 | B1 | 7/2001 | Bowling et al. | |
| 6,291,774 | B1 | 9/2001 | Williams | |
| 6,486,785 | B1 | 11/2002 | Hoth | |
| 6,559,748 | B1 | 5/2003 | Nakano | |
| 6,571,517 | B2 | 6/2003 | Wulff et al. | |
| 6,963,025 | B1 * | 11/2005 | Kysely | 174/5 R |
| 6,995,313 | B1 | 2/2006 | Barnett et al. | |
| 7,001,202 | B2 | 2/2006 | Robbins | |
| 7,009,102 | B2 * | 3/2006 | Milner | 174/139 |
| 7,075,015 | B1 | 7/2006 | Rauckman | |
| 7,201,600 | B2 | 4/2007 | Sokol et al. | |
| 7,301,096 | B2 | 11/2007 | Strong et al. | |
| 7,309,837 | B1 | 12/2007 | Rauckman | |
| 7,541,546 | B2 * | 6/2009 | Vojtila et al. | 174/138 E |
| 2007/0131447 | A1 | 6/2007 | Rauckman | |
| 2007/0261875 | A1 | 11/2007 | Kjerrumgaard | |

OTHER PUBLICATIONS

Midsun Grouip, Inc. E/Barrier™ . A de-energized applied polycarbonate barrier used to prevent inadvertent contact by animals and birds on distribution and substation equipment [online]; [retrieved on Jan. 2, 2008]; Retrieved from the internet: <URL: http://www.midsungroup.com>.

Critter Guard, Inc. Safety—Critters Awire The Solution to Squirrel Caused Power Outages [online]; [retrieved on Jan. 2, 2008]; Retrieved from the internet: <URL: http://vvww.critterguard.org/article_publicpower.htm>.

Midsun Group, Inc. E/Products. Insulating Products—Squirrel, Raccoon, Birds, Snake outage protection [online]. [retrieved on Jan. 8, 2008] Retrieved from the Internet: <URL: http://www.midsungroup.com/new_page_5.htm>.

* cited by examiner

WILDLIFE PROTECTION GUARD FOR ELECTRICAL POWER DISTRIBUTION EQUIPMENT

TECHNICAL FIELD

The present invention relates generally to electrical power distribution equipment and, more particularly, to a wildlife protection guard for high voltage power lines and high voltage power line connections.

BACKGROUND

High voltage electrical power distribution systems generally include various types of electrical terminations to high voltage power transmission lines. Such terminations may include lightning current surge arrestors, transformer bushings, capacitor bushings, regulator bushings, as well as other related high voltage power connections. Wildlife protection guards or covers are used to prevent wildlife, such as a bird, squirrel, raccoon, etc., from contacting the electrical terminations of high voltage power distribution equipment, so as to inhibit equipment short circuits and consequent power outages. The guards or covers also serve to protect wildlife from injury or death due to the electrical contact. As demand for electricity increases, the required energy infrastructure will necessarily expand, thus leading to an increasing number of electrical terminations susceptible to contact with wildlife. In addition, electrical utilities may convert to electricity distribution systems operating at higher voltages than present standards in order to help meet increases in future demand. Because of their higher voltage, these upgraded systems are even more susceptible to damage and/or power outages caused by wildlife contact with electrical terminations.

BRIEF DESCRIPTION OF DRAWINGS

Non-limiting and non-exhaustive embodiments of the present invention are described with reference to the following figures, wherein like reference numerals refer to like parts throughout the various views, unless otherwise precisely specified.

DETAILED DESCRIPTION

The terms "top", "bottom", "front", "back", and "sides" are used in the specification to describe the various views of the figures. It should be appreciated that in actual use, an embodiment of the invention may be rotated either horizontally or vertically in order to assemble or use a wildlife protection guard. As a result of such rotation, the descriptive terms may not literally apply to a particular construction. In other words, the various terms "top", "bottom", "front", "back", "sides" and the like are relative and are used herein to describe the figures for illustration purposes and are not intended to limit the embodiments shown to any particular orientation. The Figures are drawn for clarity and are not drawn to scale. Thus, the components illustrated herein can be scaled to any size.

Further, as used herein, the terms "including", "having", and variations thereof are intended to have the same meaning and effect as the term "comprising".

In accordance with one or more embodiments of the present invention, a protective wildlife guard may include (i.e., comprise) an enclosure formed by a pair of hinged half-shells, as variously shown and described in the attached Figures. The hinged half-shells are adapted to be closed by a locking mechanism adjacent mating surfaces of the hinged half-shells opposite to the hinges. When closed, the half-shells define an interior volume that can fit over an insulative bushing to encompass an electrical termination, such as a high voltage power line connection. Generally, an enclosure may have (i.e., comprise) a base member with a central opening, a sidewall extending from the base member, a tapered member extending from the sidewall, a top member on the tapered member, and first and second ports respectively provided in the top member and the tapered member. In a particularly preferred embodiment, the enclosure is constructed so as to allow the base member to be passed over a bushing skirt of the power line connection without modification or damage to the wildlife protection guard or the bushing skirt. Additionally, the first and second ports may be constructed to allow the passage of a conductor, such as a wire, a spark gap bar, or the like, therethrough into the interior of the enclosure.

Figure 1:
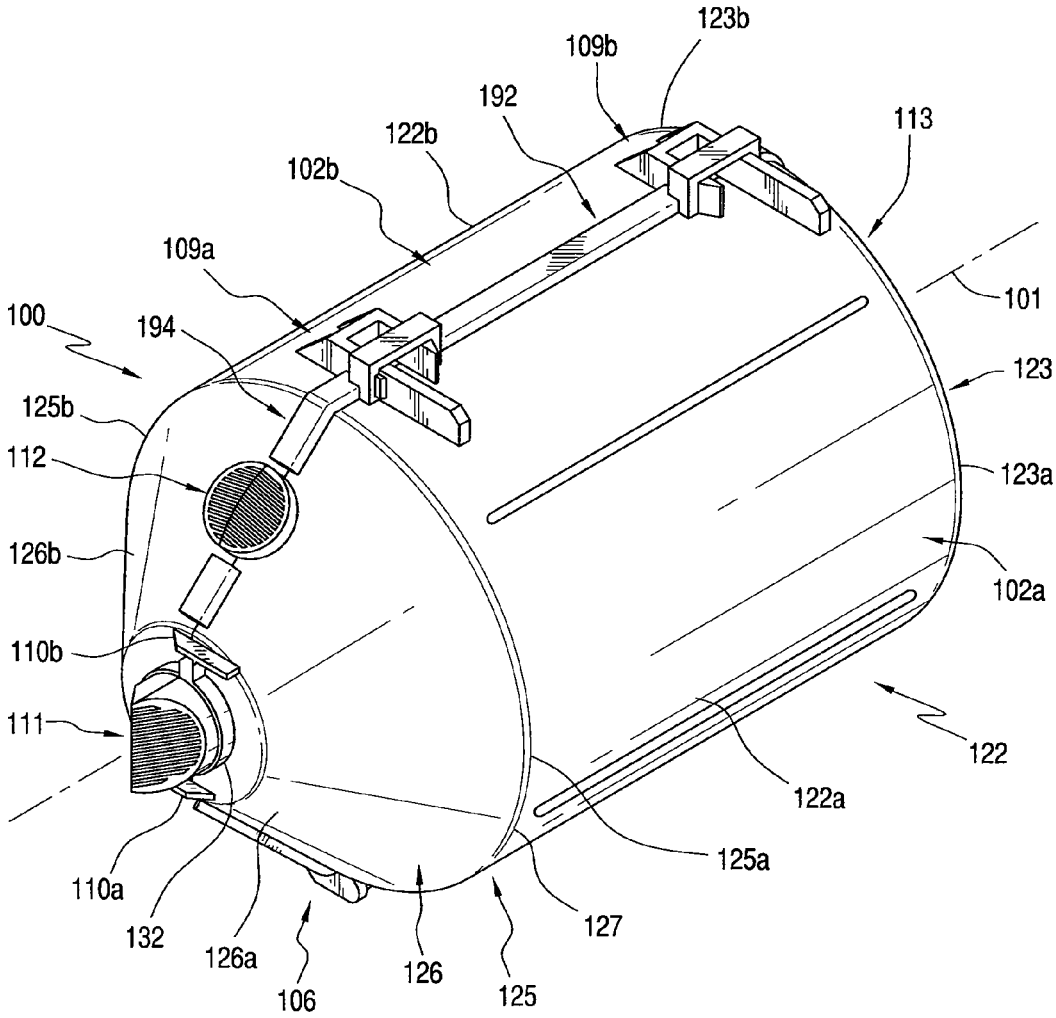
FIG. 1 is an isometric view of an exemplary embodiment of a wildlife protection guard in a closed and latched configuration.
Figure 2:
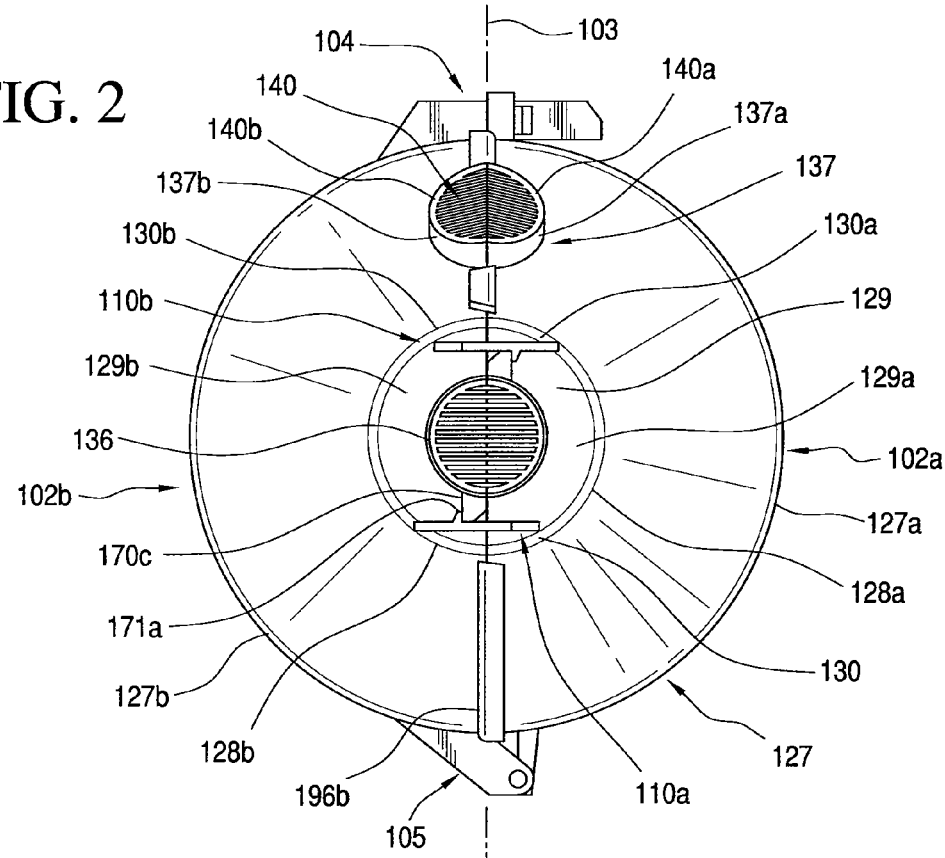
FIG. 2 is a top view of the wildlife protection guard of FIG. 1 in a closed and latched configuration.
Figure 3:
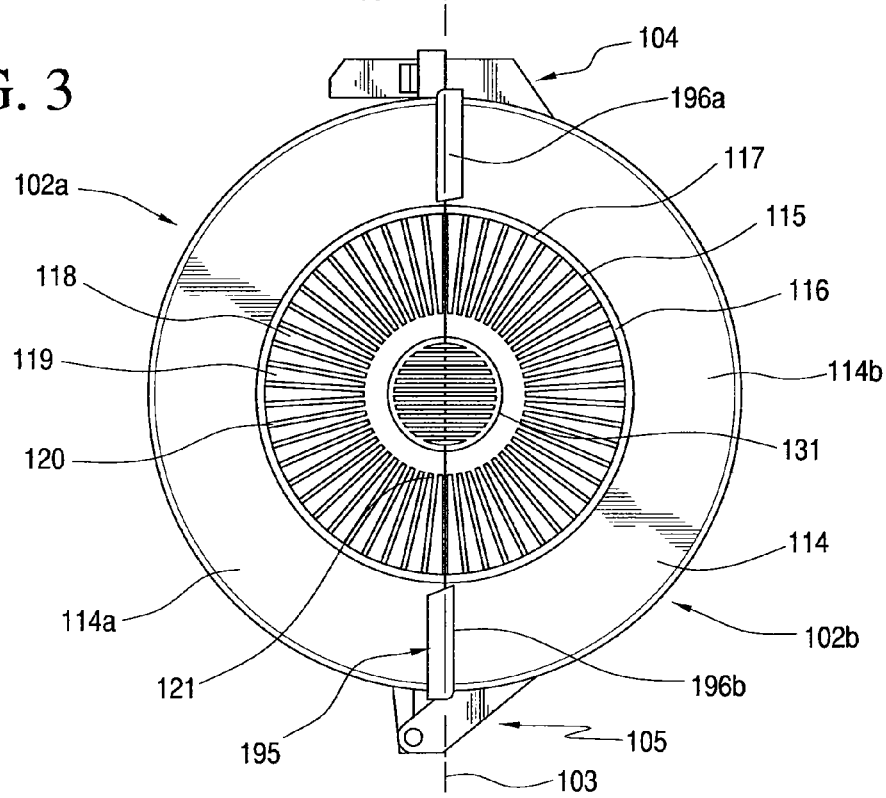
FIG. 3 is a bottom view of the wildlife protection guard of FIG. 1 in a closed and latched configuration.
Figure 4:
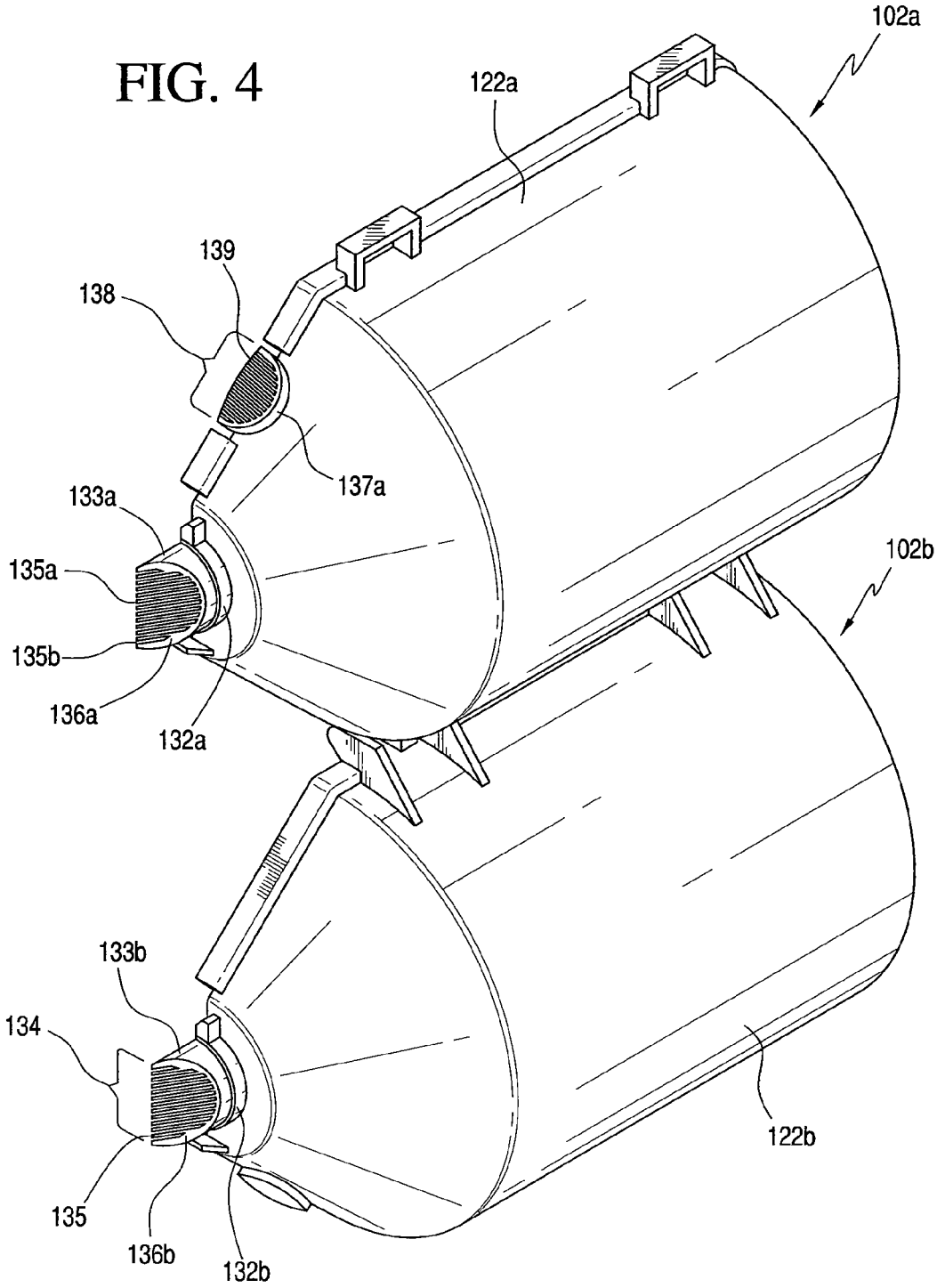
FIG. 4 is an isometric view of the external surfaces of the wildlife protection guard of FIG. 1 in an open and assembled configuration.
Figure 5:
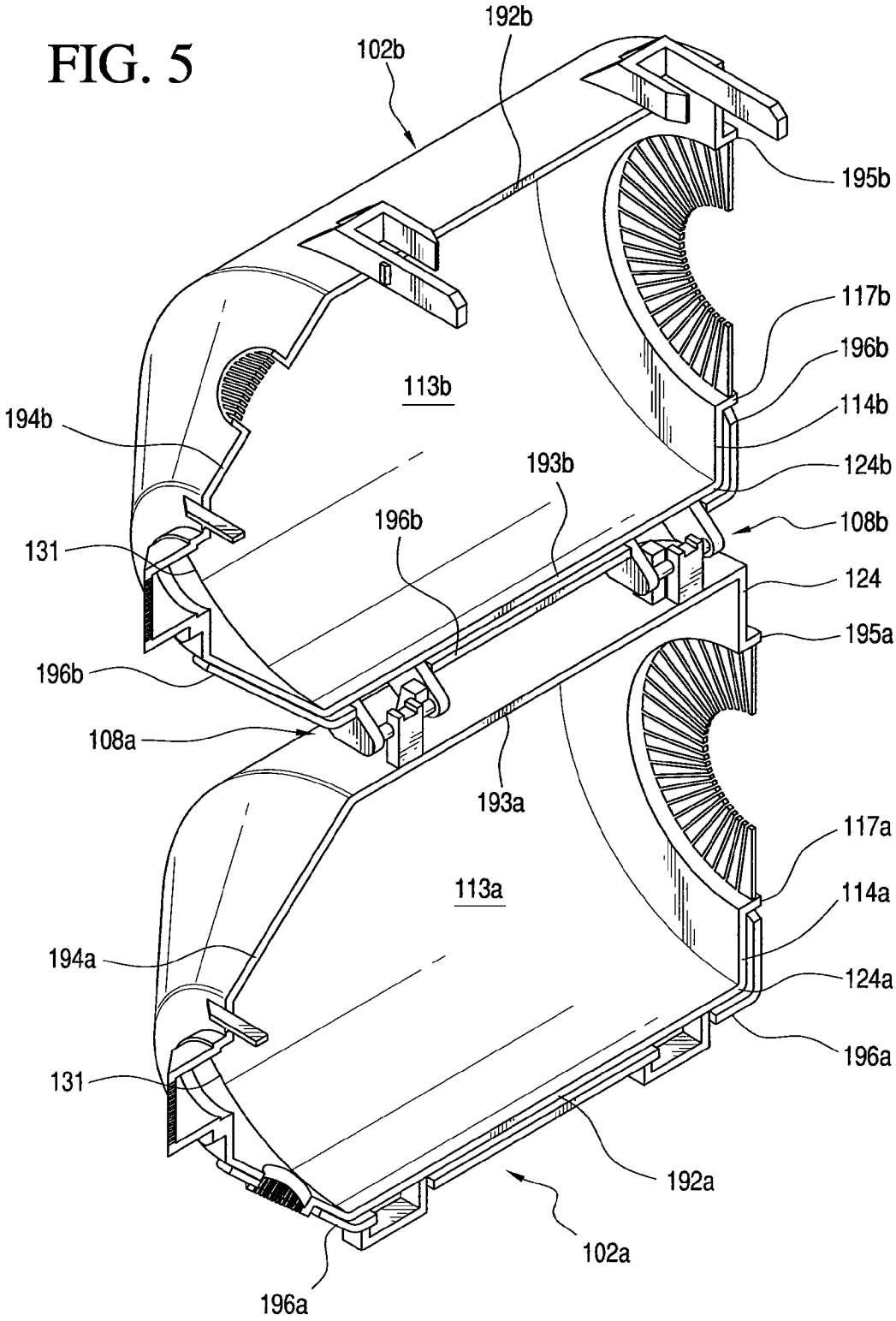
FIG. 5 is an isometric view of the interior surfaces of the wildlife protection guard of FIG. 1 in an open and assembled configuration.

Referring now to FIGS. 1-5, there is shown an exemplary embodiment of a wildlife protection guard for electrical power distribution equipment according to the present invention. FIGS. 1-3 show various views of an exemplary embodiment of a wildlife protection guard in a closed and latched configuration. FIGS. 4-5 show various views of the wildlife protection guard 100 in an open and assembled configuration.

The wildlife protection guard includes an enclosure 100 constructed to surround, for example, a power line connection (not shown). The enclosure 100 has a central axis 101 defining a center line of the enclosure. The enclosure 100 includes a first half-shell 102*a* and a second half-shell 102*b*. The half-shells 102*a*, 102*b* are defined by a mating plane 103, which extends parallel to and is coincident with the central axis 101 so as to bisect the enclosure 100. Solely for description purposes herein, the first half-shell 102*a* is referred to as the right half-shell while the second half-shell 102*b* is referred to as the left half-shell. The half-shells may substantially be mirror images of each other, except for sidewall latch mechanisms and hinge mechanisms, which are described in more detail below. Further, for description purposes only, the enclosure 100 is deemed to have a front 104, a back 105, a top 106, and a bottom 107.

In the closed configuration of FIGS. 1-3, the right half-shell 102*a* and left half-shell 102*b* are connected together by a pair of hinges 108 (i.e. a first hinge 108*a* and a second hinge 108*b*) along one side of the enclosure 100 while the opposing side is held connected together by a pair of side latches 109 (i.e. a first side latch 109*a* and a second side latch 109*b*). Thus, hinges 108 and side latches 109 are mounted on opposite sides of the enclosure at the mating plane 103. Top latches 110 (i.e., a first top latch 110*a* and a second top latch 110*b*) are also provided on the top of the enclosure 100 to more rigidly hold the right half-shell 102*a* and the left half-shell 102*b* together in the vicinity of the first port 111 (also referred to as a top port) and a second port 112 (also referred to as a side port). In the open configuration of FIGS. 4-5, top latches 110 and side latches 109 are released, thereby allowing the right half-shell 102*a* and left half-shell 102*b* to rotate with respect to each other about a pivot line defined by the pair of hinges 108. The right half-shell 102*a* encloses a right interior volume 113*a* and the left half-shell 102*b* encloses a left interior volume 113*b*. Together, the right and left half-shells 102*a*, 102*b* enclose a combined interior volume 113*a*, 113*b*, which may accommodate a power line connection.

The enclosure 100 has an annular base member 114 at the bottom 107 coaxially aligned with the central axis 101. A first central circular opening 115, which may also be coaxially aligned with the central axis 101, is defined by a first inner radial edge 116 of the base member 114. The annular base member 114 is made up of a first right semi-annular member 114*a* of the right half-shell 102*a* and a first left semi-annular member 114*b* of the left half-shell 102*b*. A cylindrical riser 117 is formed from a right semi-cylindrical riser 117*a* of the right half-shell 102*a* and a left semi-cylindrical riser 117*b* of the left half-shell 102*b*. The cylindrical riser extends from the inner radial edge 116 surrounding the first central circular opening 115 in a direction orthogonal to the plane of the base member 114 and away from the interior of the enclosure 100. From an interior edge of the cylindrical riser 117, a first plurality 118 of flexible fingers 119 extends radially inwardly toward the central axis 101 and terminating short of the central axis 101.

Each flexible finger 119 may be tapered along its length so as to maintain a constant gap 120 width between adjacent fingers. The length of each finger 119 is chosen such that the fingers 119 do not extend completely to the central axis 101, but instead define a second central circular opening 121. In accordance with at least one embodiment of the present invention, the base member 114, the first central circular opening 115, the plurality 118 of fingers 119, and the second central circular opening 121 are sized and shaped so as to allow the base member to be passed or forced over a bushing or bushing skirt of a power line connection without modification or damage to the wildlife protection guard, the bushing, and/or the bushing skirt. In particular, the diameter of the second central circular opening 121 may be in the range of the smallest outer diameter of an inner core portion of an insulative bushing of a power connection. The diameter of the first central circular opening 115 could be in the range of the largest outer diameter of an outer skirt portion of an insulative bushing of a power connection.

As shown, the flexible fingers 119 may extend in a plane parallel to the base member 114. However, it is also contemplated that the flexible fingers 119 may be angled with respect to the plane of the base member 114. For example, the fingers 119 may be angled away from or towards the interior of the enclosure so as to define a conical-type surface. In yet another alternative embodiment, the cylindrical riser 117 may extend from the inner radial edge 116 at an oblique angle with respect to the plane of the base member 114 and/or toward the interior of the enclosure 100. In still another alternative embodiment, the cylindrical riser 117 may be eliminated altogether such that the plurality 118 of fingers 119 extends directly from the inner radial edge 116 of the base member 114.

In the closed configuration of the enclosure 100, a right semi-cylindrical sidewall 122*a* and a left semi-cylindrical sidewall 122*b* define a substantially cylindrical sidewall member 122 coaxially aligned with the central axis 101 and extending from the base member 114. The right semi-cylindrical sidewall 122*a* of the right half-shell 102*a* has a lower edge 123*a* that intersects with the base member 114 at the right outer peripheral edge 124*a* of the right semi-annular member 114*a*. Similarly, the left semi-cylindrical sidewall 122*b* of the left half-shell 102*b* has a lower edge 123*b* that intersects with the base member 114 at the left outer peripheral edge 124*b* of the left semi-annular member 114*b*. The right semi-cylindrical sidewall 122*a* extends in a direction parallel to the central axis 101 and terminates at a first right top edge 125*a*. The left semi-cylindrical sidewall 122*b* also extends parallel to the central axis 101 and terminates at a first left top edge 125*b*.

It is also contemplated that the cylindrical sidewall 122 may instead extend out an oblique angle from the base member 114. For example, the right and left sidewalls 122*a*, 122*b* may be angled away from or towards the interior of the enclosure so as to define a conical surface. Additionally, the lower edges of the right and left sidewalls 122*a*, 122*b* do not need to intersect with the base member 114 at the respective outer peripheral edges 124*a*, 124*b*. In an alternative embodiment, the base member 114 may extend beyond the sidewalls 122*a*, 122*b*, such that the outer peripheral edges 124*a*, 124*b* are located at a larger radial distance from the central axis 101 than the right and left sidewalls 122*a*, 122*b*. This extension of the base member 114 beyond the cylindrical sidewall 122 may serve as a flange to aid in the installation and manipulation of the wildlife protection guard. It is also noted that the intersection of outer peripheral edges 114 and lower edge 123 may be squared, rounded, filleted, or chamfered (i.e., beveled).

When in the closed configuration for the enclosure 100, a right tapered surface 126*a* and a left tapered surface 126*b* define a tapered top member 126 coaxially aligned with the central axis 101 and extending from the cylindrical sidewall member 122. As shown in the Figures, the tapered top member 126 is shaped to form a substantially conical surface which is truncated at the top 106 to have a planar surface instead of a point. A right tapered surface 126*a* of the right half-shell 102*a* has a right lower edge 127*a* that intersects with the right semi-cylindrical member 172*a* at its first right edge 125*a*. Similarly, a left tapered surface 126*b* of the left half-shell 102*b* has a left lower edge 127*b* that intersects with the left semi-cylindrical member 122*b* at its first left edge 125*b*. Both the right tapered surface 126*a* and the left tapered surface 126*b* extend away from the base member 114 and towards the central axis 101. The right tapered surface 126*a* extends from the first right lower edge 127*a* to a second right top edge 128*a* radially displaced from the central axis 101. The left tapered surface 126*b* extends from the first left lower edge 127*b* to a second left top edge 128*b* radially displaced from the central axis 101. Thus, the tapered top member 126 defined by the right tapered surface 126*a* and the left tapered surface 126*b* has a cross-sectional diameter in a direction perpendicular to the central axis 101 which linearly decreases with increasing distance from the base member 114.

It is also contemplated that the tapered top member 126 may have other cross-sectional shapes, such as polygonal, arcuate, or semi-arcuate. Further, it is not essential for the lower edge 127 of the tapered surface 126 to intersect with the cylindrical sidewall 122 at the first top edge 125. In an alternative embodiment, the lower edge 127 of the tapered surface 126 may be displaced radially inwardly or radially outwardly with respect to the respective first top edge 125. Such a configuration may define a flange which can aid in the installation and manipulation of the wildlife protection guard.

Generally, the tapered top member 126 should have a larger cross-section proximal to the cylindrical sidewall 122 than a cross-section distal from the cylindrical sidewall 122. However, the profile of the surface of the tapered top member 126 necessary to achieve such a configuration can vary. Thus, the tapered top member 126 may be shaped in other configurations than the linearly decreasing cross-sectional diameter. For example, the surface of the tapered top member 126 may have a stepped configuration such that intervals along the surface of the top member 126 alternately extend parallel and perpendicular to the central axis 101. In yet another alternative embodiment, the top member may be tapered to have a non-linearly decreasing cross-sectional diameter. For example, instead of having a truncated cone geometry, the top member may have a cross-section defined by the mating plane 103 that is polygonal, arcuate, semi-arcuate, or that follows a polynomial or exponential curve.

Although the tapered top member 126 is shown in the Figures as having a smaller length (as measured along the central axis 101) than the cylindrical sidewall 122, it is noted that the Figures have not been drawn to scale. Accordingly, the components illustrated herein may be scaled to any size. Thus, in an alternative embodiment, the tapered top member 126 may be longer than the cylindrical sidewall 122. It is also noted that the intersection at first top edge 125 of the cylindrical sidewalls 122 and the lower edge 127 of tapered top member 126 may be squared, rounded, filleted, or chamfered (i.e., beveled).

At the top of the enclosure 100 in the closed configuration is a top planar ledge 129 extending from the top periphery 128 of the tapered top member 126 toward the central axis 101 and terminating short thereof. The ledge 129 is defined by a second right semi-annular surface 129*a* of the right half-shell 102*a* and a second left semi-annular surface 129*b* of the left half-shell 102*b*. The right semi-annular surface 129*a* has a right second outer edge 130*a* that intersects with the right tapered surface 126*a* at its second right top edge 128*a*. The left semi-annular surface 129*b* has a left second outer edge 130*b* that intersects with the left tapered surface 126*b* at its second left top edge 128*b*. The right and left semi-annular surfaces 129*a*, 129*b* extend from their respective second edges 130*a*, 130*b* toward the central axis 101 in a plane perpendicular to the central axis 101. Together, the right and left semi-annular surfaces 129*a*, 129*b* form a central top opening 131 when the enclosure is in a closed configuration. The central opening is coaxially aligned with the central axis 101.

It is also contemplated that the right and left semi-annular surfaces 129*a*, 129*b* may have other cross-sectional shapes, such as polygonal, arcuate, or semi-arcuate. Further, it is not essential for the top edge 128 of the tapered surface 126 to intersect with the top planar ledge 129 at the outer edge 130. In an alternative embodiment, the outer edge 130 of the planar ledge 129 may be displaced radially outward with respect to the top edge 128. Such a configuration may define a flange which can aid in the installation and manipulation of the wildlife protection guard. It is also noted that the intersection of the top edge 128 with the outer edge 130 may be squared, rounded, filleted, or chamfered.

A top port 111 may be adjacent to and aligned with the central opening 131 formed by the top planar ledge 129. The top port 111 may include a cylindrical riser 132, a first variable length cylindrical extension member 133, and an array 134 of flexible fingers 135. The cylindrical riser 132 is defined by a right semi-cylindrical riser portion 132*a* on the right half-shell 102*a* and a left semi-cylindrical riser portion 132*b* on the left half-shell 102*b*. The right semi-cylindrical riser portion 132*a* has a variable length extension member 133*a*. Similarly, the left semi-cylindrical riser portion 132*b* has a variable length extension member 133*b*. Together, the extension members 133*a*, 133*b* define a variable length cylindrical extension member 133 extending coaxially from the cylindrical riser 132 and parallel to the central axis 101. The cylindrical extension member 133 may have a smaller radius than the corresponding cylindrical riser portion 132, such that the extension member 133 is radially inwardly displaced with respect to the riser 132. The intersection between the extension member 133 and the riser 132 may be squared, rounded, filleted, or chamfered.

The extension member 133 has a variable length in the direction of the central axis 101. In particular, the length of the extension member 133 may vary along its circumference from a maximum for points lying closest to the mating plane 103 to a minimum for points farthest from the mating plane 103. First semi-cylindrical extension member 133*a* has a top peripheral edge 136*a* distal from the top planar ledge 129. Similarly, second semi-cylindrical extension member 133*b* has a top peripheral edge 136*b* distal from the top planar ledge 129. From the top peripheral edge 136 (i.e., edges 136*a* and 136*b*) extends an array 134 of flexible fingers 135. Each of the flexible fingers 135 in the array 134 extend parallel to the other fingers in the array at an angle with respect to the mating plane, such that the ends of the flexible fingers in the array 134 of the left half-shell 102*b* and the ends of the flexible fingers of the array 134 of the right half-shell 102*a* meet at a line coincident with the mating plane 103. The length and angle of the flexible fingers in the array 134 are chosen such that the fingers 135 from different half shells meet at their ends. For example, the flexible fingers in the array 134 may extend at a 45° angle with respect to the mating plane 103.

The flexible fingers 135 of the array 134 have a length which varies depending on the location of the finger 135 on the top peripheral edge 136 of the variable length extension member 133. Those fingers 135*a* of the array 134 extending from points on the top peripheral edge 136 farthest from the mating plane 103 have the longest length. Such a configuration enables the flexible fingers closest to the center of the array 134 to have the greatest flexibility, thereby allowing conductors to easily pass through the center of the top port 111. Conversely, fingers 135*b* closest to the mating plane (i.e., farthest from the center of the array 134) have the least flexibility, thereby effecting sealing around the conductors passing through the center of the top port 111.

It is also contemplated that the flexible fingers 135 in the array 134 may extend at a 90° angle with respect to the mating plane 103. In such an alternate embodiment, the extension member 133 may be removed such that the fingers extend directly from inner edges of the cylindrical riser 132. It is also contemplated that the riser 132 and the extension member 133 may be removed from the enclosure 100 altogether. In such an alternate embodiment, the array 134 of flexible fingers can be arranged to extend directly from an inner surface of the central opening 131 formed by top planar ledge 129 and at any angle with respect to the mating plane 103. Further, the fingers 135 of the top port may be arranged to extend in a radial fashion similar to the configuration of the array 118 of fingers 119 on the bottom of the enclosure.

A side port 112 may be formed in a sidewall of the tapered top member 126. In particular, the side port 112 may be formed at a location bisected by the mating plane such that half of the side port 112 is supported by the right half-shell 102*a* and the other half of the side port 112 is supported by the left half-shell 102*b*. The side port 112 may be formed at a location on the sidewall of the tapered top member 126 which is intermediate between the top edge 128 of the tapered top member 126 and the lower edge 127 of the tapered top member 126. In accordance with at least one embodiment of the present invention, the side port 112 is located on the surface of the tapered top member 126 at a midpoint of the length extending from the top edge 128 to the lower edge 127 of the tapered top member 126.

The side port 112 includes a second variable length cylindrical extension member 137 centered on an opening in the tapered top member 126 and a third array 138 of flexible fingers 139 extending from the cylindrical extension member 137. The cylindrical extension member 137 is formed by a first semi-cylindrical variable length member 137*a* formed on the right half-shell 102*a* and a second semi-cylindrical variable length member 137*b* formed on the left half-shell 102*b*. The intersection between the cylindrical extension member 137 and the surface of the tapered top member 126 may be squared, rounded, filleted, or chamfered.

Each semi-cylindrical extension member 137*a*, 137*b* has a variable length in a direction of a plane parallel to the opening in the surface of the truncated top member 126. In particular, the length of the semi-cylindrical extension member 137*a*, 137*b* may vary along its circumference from a maximum for points lying closest to the mating plane 103 to a minimum for points farthest from the mating plane 103. First semi-cylindrical extension member 137*a* has a top peripheral edge 140*a* distal from the surface of the truncated top member 126. Similarly, second semi-cylindrical extension member 137*b* has a top peripheral edge 140*b* distal from the surface of the truncated top member 126. Together, edges 140*a* and 140*b* define a top peripheral edge 140 of the cylindrical extension member 137. From this top peripheral edge 140 extends an array 138 of flexible fingers 139. Each of the flexible fingers in the array 138 extend parallel to the other fingers in its half of the array and at an angle with respect to the mating plane 103, such that the ends of the flexible fingers in the array 138 of the left half-shell 102*b* and the ends of the flexible fingers of the array 138 of the right half-shell 102*a* meet at a line coincident with the mating plane 103. The length and angle of the flexible fingers in the array 138 are chosen such that the fingers 139 meet at their ends. For example, but not limited to, the flexible fingers 139 in the array 138 may extend at a 75° angle with respect to the mating plane 103.

The flexible fingers of the array 138 have a length which varies depending on the location of the finger on the top peripheral edge 140. Those fingers of the array 138 extending from points on the top peripheral edge 140 farthest from the mating plane 103 have the longest length. Such a configuration enables the flexible fingers closest to the center of the array 138 to have the greatest flexibility, thereby allowing conductors to easily pass through the center of the side port 114. Conversely, fingers farthest from the center of the array 138 have the least flexibility, thereby effecting sealing around the conductors passing through the center of the side port 112.

It is also contemplated that the flexible fingers in the array 138 may extend at a 90° angle with respect to the mating plane 103. In one such alternate embodiment, the cylindrical extension member 137 may have a flat distal edge 140 so that the flexible fingers in the array 138 may extend at a 90° angle with respect to and meet at the mating plane 103. In another such alternate embodiment, the cylindrical extension member 137 may be removed such that the fingers 139 extend from inner edges of the opening in the surface of the truncated top member 126. It is also contemplated that a separate cylindrical riser may be employed with extension member 137 in the same manner as applied to the top port 111. Further, the fingers 139 of the side port may be arranged to extend in a radial fashion similar to the configuration of the array 118 of fingers 119 on the bottom of the enclosure.

Figure 13:
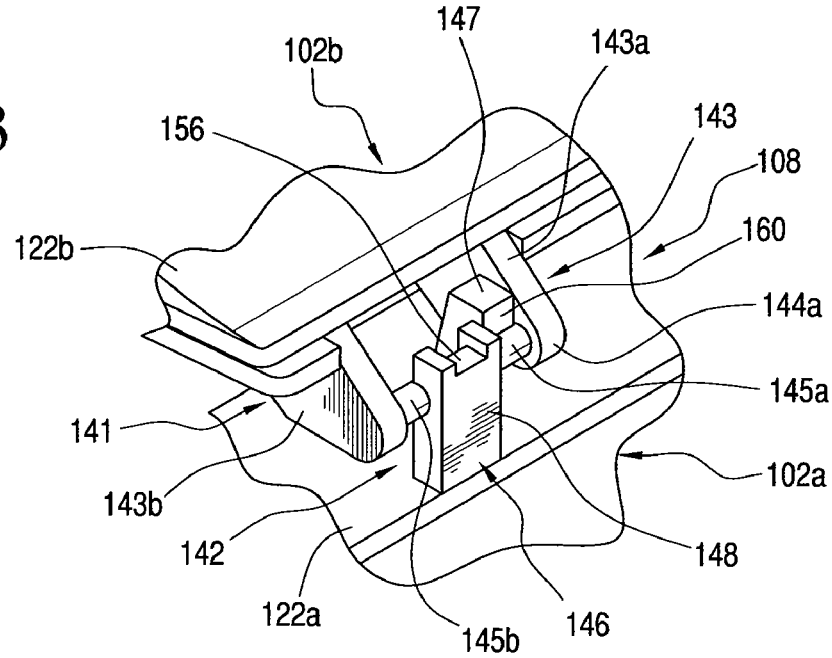
FIG. 13 is an enlarged isometric view of a hinge of the wildlife protection guard of FIG. 1.
Figure 14:
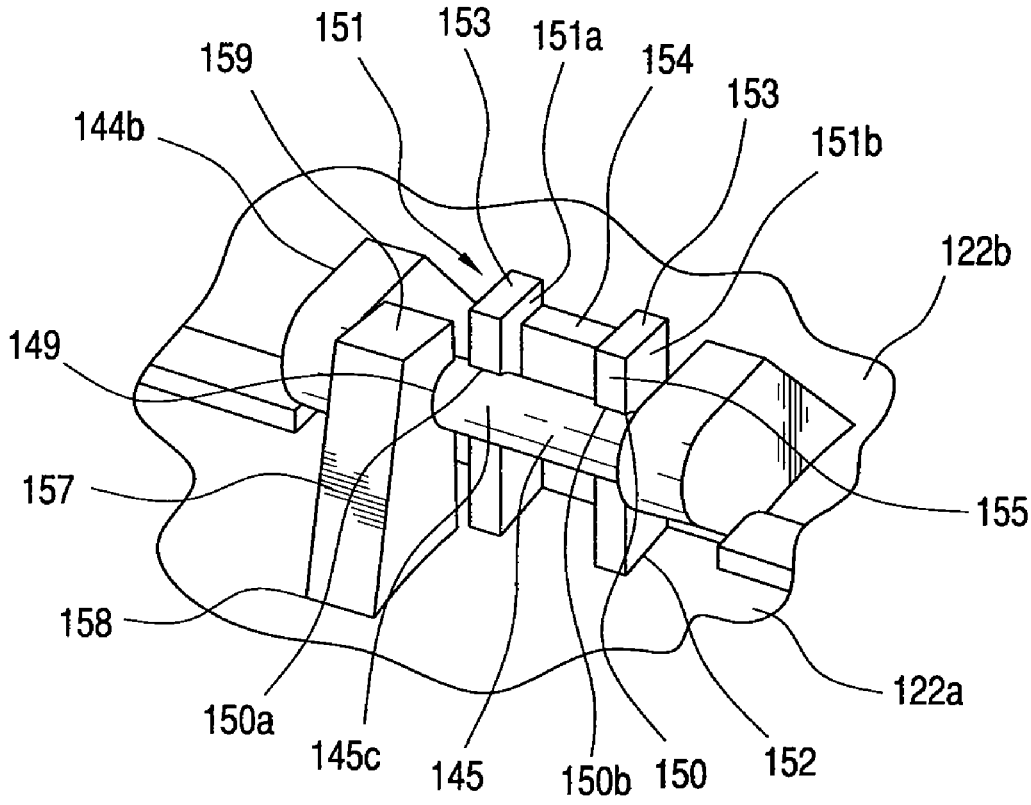
FIG. 14 is an enlarged isometric view of the hinge of the wildlife protection guard of FIG. 1. The viewing direction of FIG. 14 is substantially orthogonal to the viewing direction of FIG. 13.

As discussed above, the left half-shell 102*b* and right half-shell 102*a* are held together along the back 105 side of the enclosure 100 by a pair of hinges 108. FIGS. 13 and 14 show an embodiment of a hinge 108 of the present invention in magnified detail. FIG. 13 is an enlarged isometric view of the hinge 108 of the present invention. FIG. 14 is a substantially orthogonal isometric view to that of FIG. 13 showing additional features of the hinge 108.

Each hinge 108 has a first hinge portion 141 provided on the left half-shell 102*b* and a second hinge portion 142 provided on the right half-shell 102*b*. Note that the location of the first and second hinge portions may be reversed without affecting the function of the hinge 108. In particular, the first hinge portion 141 may be provided on the right half-shell 102*a* while the second hinge portion 142 may be provided on the left half-shell 102*b*. It is further noted that one of the pair of hinges 108*a*, 108*b* may have an opposite orientation compared to that of the other hinge 108*a*, 108*b*. That is, the first hinge portion 141 of one hinge 108*a* may be provided on the left half-shell 102*b* while the second hinge portion 142 of the other hinge 108*b* may be provided on the right half-shell 102*a*.

The first hinge portion 141 includes a first support leg 143*a* and a second support leg 143*b*, serving as a hinge pin support 143, on the surface of the left semi-cylindrical sidewall 122*b*. The first and second support legs 143*a*, 143*b* extend outwardly from the left semi-cylindrical sidewall 122*b* and toward the mating plane 103 such that a free end 144 of each leg 143*a*, 143*b* extends beyond the mating plane 103. The first and second support legs 143*a*, 143*b* support a cylindrical hinge pin 145 therebetween. The cylindrical hinge pin 145 is arranged parallel to the mating plane 103.

The second hinge portion 142 includes a first engagement member 146 and a second engagement member 147 formed on the surface of the right semi-cylindrical sidewall 122*a*. The first engagement member 146 is arranged to embrace one side of the hinge pin 145 while the second engagement member 147 is arranged to engage the other side of the hinge pin 145. The first engagement member 146 may be arranged to have a planar face 148 opposite to the hinge pin 145 that is parallel and directly adjacent to the mating plane 103. The first and second engagement members 146,147 are arranged such that their respective engagement portions 149,150 are in an offset, opposing configuration. By such a configuration, the hinge pin 145 may be held between the first and second engagement members 146,147, thereby allowing the right half-shell 102*a* and the left half-shell 102*b* to rotate with respect to each other about an axis of the hinge pin 145.

The first engagement member 146 may include a first hinge post mechanism 151 having a pair of identical and substantially parallel hinge posts (i.e., the first hinge post 151*a* and the second hinge post 151*b*) formed on the surface of the right semi-cylindrical sidewall 122*a*. Each of the hinge posts 151*a*, 151*b* is fixed to the right semi-cylindrical sidewall 122*a* at a first end 152 and extends perpendicular from the right semi-cylindrical sidewall 122*a* to a top surface 153. The hinge posts 151*a*, 151*b* may be connected to each other by a fixed connecting member 154 extending therebetween. Hinge posts 151*a*, 151*b* each have a substantially arcuate recess 150 formed on the engagement surface 155 of the hinge posts 151. The recess 150 is sized and shaped to engage at least a portion of the circumference of hinge pin 145. Connecting member 154 may be spaced away from the hinge pin 145 such that only the substantially arcuate recess 150 of hinge posts 151*a*, 151*b* engage the hinge pin 145. Further, the connecting member 154 may also be fixed to the surface of the right semi-cylindrical sidewall 122*a* to increase the rigidity of the second hinge portion 142. The connecting member 154 may also have a top surface 156 located closer to the right semi-cylindrical sidewall 122*a* than the top surfaces 153 of the hinge posts 151.

The second engagement member 147 may be substantially a single hinge post 157 also formed on the surface of the right semi-cylindrical sidewall 122*a* at a first end 158 and extends perpendicular from the surface of the right semi-cylindrical sidewall 122*a* to a top surface 159. The second engagement member 147 has a substantially arcuate recess 149 formed on the engagement surface 160 of the single hinge post 157. The recess 149 is sized and shaped to engage at least a portion of the circumference of hinge pin 145. Unlike the first engagement member 146, the engagement surface 160 of the second engagement member 147 faces the mating plane 103. Thus, the first engagement member 146 and the second engagement member are arranged in an offset, opposing configuration so as to embrace both sides of the hinge pin 145.

To assemble the left half-shell 102*b* to the right half-shell 102*a*, the hinge pin 145 of the left half-shell 102*b* is snapped into place between the arcuate recesses 149,150 of the second hinge portion 142. To facilitate the assembly, the engagement surface 155 of hinge posts 151 may be chamfered and/or beveled in a region near the top surface 153. Similarly, the engagement surface 160 of the second engagement member 147 may optionally be chamfered in a region near the top surface 159. Alternately, other modifications may be employed to allow for easy assembly. For example, instead of chamfering or beveling, a filleted profile could be used in the regions of the engagement surfaces near the top of the hinge posts.

In addition, the engagement portions of the first and second engagement members may embrace, in combination, less than the entire circumference of the hinge pin. For example, arcuate recess 149 of the second engagement member 147 may extend 180° or less around the circumference of the hinge pin 145. The arcuate recess 150 of the first engagement member 146 may also extend 180° or less around the circumference of the hinge pin 145. Thus, at least a portion of the circumference of the hinge pin 145 along the entire length of the hinge pin 145 may not be embraced by the engagement members 146, 147. It is further noted that the arcuate recesses need not have the same dimensions as the hinge pin. For instance, clearance may be introduced into the hinge 108 by having arcuate recesses with a larger radius than that of the hinge pin 145, so as to allow free rotation about the hinge pin while minimizing frictional forces. It is also contemplated that a different cross-section may be used for the profile of the engagement recesses 149,150 than the profile of the hinge pin 145. For example, while hinge pin 145 may have a circular cross-section, engagement portions 149,150 may have a parabolic profile to minimize surface contact while still securing the hinge pin 145 to the hinge 108.

It is also noted with reference to FIGS. 13 and 14 that the engagement portions 149,150 of the first and second engagement members 146, 147 can be spaced out along the length of the hinge pin 145. For example, the hinge pin 145 has a first end portion 145*a*, a second end portion 145*b*, and a center portion 145*c*. The pair of end portions 145*a*,145*b* are adjacent to the hinge pin supports 143*a*,143*b* and the center portion 145*c* is between the end portions 145*a*,145*b*. One of the hinge posts 151*b* of the first engagement member 146 may be arranged substantially adjacent to the center portion 145*c* of the hinge pin 145. The other hinge post 151*a* of the first engagement member 146 may be arranged substantially adjacent to the end portion 145*a* of the hinge pin 145. The second engagement member 147 may be arranged substantially adjacent to the other end portion 145*b* of the hinge pin 145. Thus, the hinge pin 145 may be supported by the engagement members along its entire length.

A width of the engagement portion 149 of the second engagement member 147 in a direction parallel to the mating plane 103 may be larger than either of the widths of the engagement portions 150 of the first engagement member 146 in a direction parallel to the mating plane 103. For example, but not limited to, the width of the engagement portion 147 may be substantially equal to the combined widths of the pair of engagement portions 150*a*,150*b*.

As shown in FIG. 5, a pair of hinges 108*a*, 108*b* may be employed, with hinge 108*a* located closer to the top 106 and another hinge 108*b* located closer to the bottom 107. In alternative embodiments, fewer or additional hinges may be used. For example, a single hinge 108 may be employed at the center of the cylindrical sidewall 122 of the enclosure 100. In an alternative embodiment, the pair of hinges 108*a*, 108*b* shown in FIG. 5 may be combined into a single hinge having a common hinge pin 145 extending between top and bottom engagement posts.

Note that arrangement of the components of the hinge 108 allows the hinge 108 to be in an unstressed state during use and operation. That is, stress is only applied to the hinge 108 during assembly of the hinge 108 (i.e., snapping of hinge pin 145 into engagement portions 149, 150 of the second hinge portion 142) or possibly during installation of the enclosure 100 in the field. At all other times, the hinge 108 is relatively unstressed, thereby improving the reliability and durability of the hinge 108 and the enclosure 100.

Figure 7:
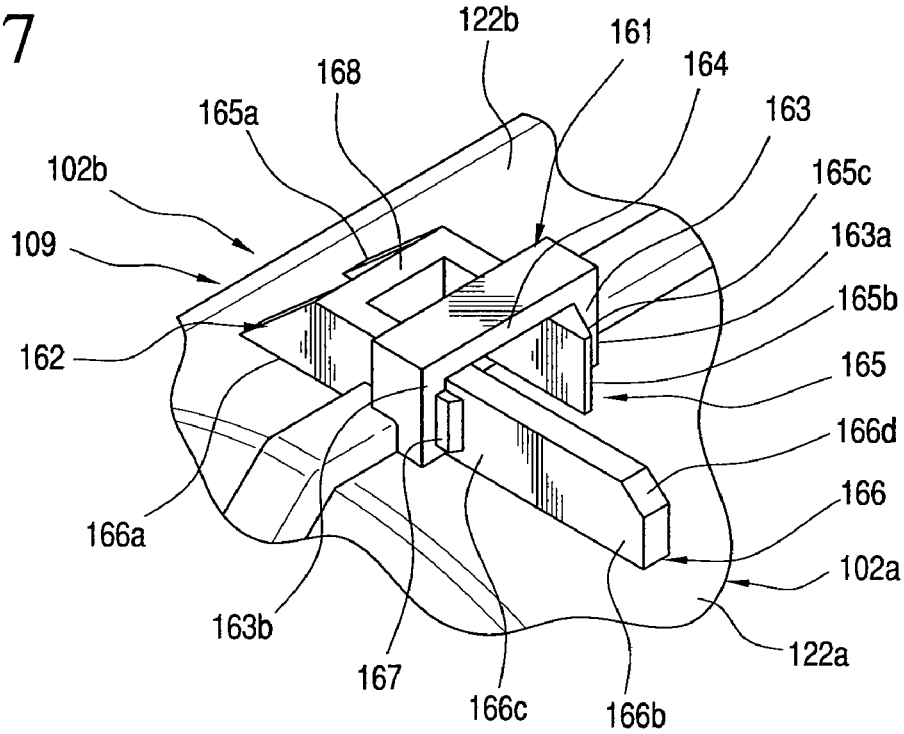
FIG. 7 is an enlarged isometric view of a side latch of the wildlife protection guard of FIG. 1.

As discussed above, opposite to the pair of hinges 108 along the front 104 side of the enclosure 100 are a pair of side latches 109*a*, 109*b*. FIG. 7 shows, in magnified detail, the side latch 109 in a latched position in accordance with an embodiment of the present invention.

Each side latch 109 includes a first cooperating member 161 and a second cooperating member 162. The first cooperating member 161 is formed on the right half-shell 102*a* while the second cooperating member 162 is formed on the left half-shell 102*b*. Note that the location of the first and second cooperating members 161,162 may be reversed without affecting the function of the side latch 109. In particular, the first cooperating member 161 may be provided on the left half-shell 102*b* and the second cooperating member 162 may be provided on the right half-shell 102*a*. It is further noted that the first side latch 109*a* may have an opposite orientation compared to the second side latch 109*b*. That is, the first side latch 109*a* may have a first cooperating member 161 on the left half-shell 102*b* while the second side latch 109*b* may have a second cooperating member 162 on the left half-shell 102*b*.

The first cooperating member 161 has a substantially upside-down, U-shaped configuration when viewed from a direction perpendicular to the mating plane 103. The first cooperating member 161 is fixed to the right semi-cylindrical sidewall 122*a* of the right half-shell 102*a* by legs 163 (i.e., a first support leg 163*a* and a second support leg 163*b*), which extend perpendicularly to the surface of the right semi-cylindrical sidewall 122*a*. Legs 163 also extend parallel and directly adjacent to the mating plane 103. Connecting the legs 163 together is a crossbar 164, which extends from the top of leg 163*a* to the top of leg 163*b*. Crossbar 164 is also parallel and directly adjacent to the mating plane 103. Interior surfaces of the legs 163 and the crossbar 164 which face the second cooperating member 162 may be chamfered, beveled, or filleted to facilitate insertion of the second cooperating member 162 therein.

The second cooperating member 162 is fixed to the left semi-cylindrical sidewall 122*b* of the left half-shell 102*b*. The second cooperating member 162 includes a first elongated finger 165 and a second elongated finger 166. Both fingers 165,166 extend in a direction perpendicular to the mating plane 103.

The first elongated finger 165 has a first fixed end 165*a* mounted on the left half-shell 102*b* and a first free end 165*b*, which extends beyond the mating plane 103. The first elongated finger 165 has a parallel surface facing the interior surface of the first support leg 163*a* of the first cooperating member 161 such that, upon insertion of the second cooperating member 162 into the first cooperating member 161, the parallel surface and the interior surface of leg 163*a* contact each other. At the free end 165*b*, the first elongated finger 165 may be tapered at surface 165*c* that faces and contacts leg 163*a* of the first cooperating member 161 when the second cooperating member 162 is inserted into the first cooperating member 161. Alternately, the first elongate finger 165 may be chamfered, filleted, or beveled to assist in insertion into the first cooperating member 161.

The second elongated finger 166 has a second fixed end 166*a* mounted on the left half-shell 102*b* that is similar in size and shape to the first fixed end 165*a* of the first elongated finger 165. However, the second elongated finger 166 has a second free end 166*b* which extends further beyond the mating plane 103 than the first elongated finger 166. In accordance with at least one embodiment of the present invention, the second free end 166*b* has sufficient length such that it may be manipulated by hand (i.e. depressed by pressing with a finger) even when the second cooperating member 162 is fully inserted into the first cooperating member 161. The second elongated finger 166 has a parallel surface 166*c* facing the interior surface of the second support leg 163*b* of the first cooperating member such that, upon insertion of the second cooperating member 162 into the first cooperating member 161, the parallel surface and the interior surface of second support leg 163*b* contact each other. In addition, the second elongated finger 166 includes a detent 167 provided on a surface 166*c* of the second elongated finger 166. As illustrated in FIG. 7, the detent 167 is chamfered at an end closest to the second free 166*b* to assist in insertion of the second elongated finger 166 into the first cooperating member 161. In addition, the detent 167 may instead be filleted or beveled. Alternately, detent 167 may be tapered at a surface that faces and contacts leg 163*b* of the first cooperating member 161 when the second cooperating member 162 is inserted into the first cooperating member 161. The free end 166*b* of the second elongated finger 166 may be chamfered or beveled at a surface 166*d* that would interact with crossbar 164 of the first cooperating member, to assist in insertion of the second elongated finger 166 into the first cooperating member. Alternately, the free end 166*b* at surface 166*d* may be filleted or tapered.

The first elongated finger 165 and the second elongated finger 166 may be connected together by an optional connecting piece 168. Connecting piece 168 extends between the first elongated finger 165 and the second elongated finger 166 parallel to and spaced apart from the mating plane. The connecting piece 168 is also fixed to the left half-shell 102*b*. As shown in FIG. 7, the connecting piece 168 connects a portion of the first fixed end 165*a* of the first elongated finger 165 and the second fixed end 166*a* of the second elongated finger 166. Alternately, connecting piece 168 may connect the entire first fixed end 165*a* to the entire second fixed end 166*a*, a portion of the first fixed end 165*a* to a different portion of the second fixed end 166*a*, the entire first fixed end 165*a* to a portion of the second fixed end 166*a*, or vice-versa. In addition, connecting piece 168 may extend past the mating plane so as to additionally connect a portion of the first free end 165*b* of the first elongated finger 165 to a portion of the second free end 166*b* of the second elongated finger 166. However, in such a configuration, the size of the connecting piece should be judiciously selected so as not to adversely affect the flexible nature of the elongated fingers 165,166 necessary for the latching effect.

When closing the enclosure 100, the second free end 166*b* of the second elongated finger 166 is initially pushed into the interior region between the legs and the cross-bar of the first cooperating member 161. Once the second cooperating member 162 has been inserted a sufficient distance into the first cooperating member 161 such that the first elongated finger 165 reaches the first cooperating member 161, the first free end 165*a* of the first elongated finger is similarly inserted into the interior region of the first cooperating member 161. Further insertion causes the detent 167 to push on one of the legs 163*b* of the first cooperating member 161 thereby flexing the second elongated finger 166 toward the interior of the first cooperating member. The second cooperating member is fully inserted into the first cooperating member when detent 167 proceeds through the interior of the first cooperating member to a side distal from the mating plane 103. As it proceeds past the leg 163*b*, detent 167 snaps into place adjacent a surface of the leg 163*b* distal from the mating plane 103. Once detent 167 is adjacent to the distal surface of the leg 163*b*, the second elongated finger is no longer flexed and the detent 167 inhibits disengagement of the second cooperating member 162 from the first cooperating member 161. As a result, the left half-shell 102*b* is latched to the right half-shell 102*a*. In an alternate embodiment, the contacting surfaces of the leg 163*b* and the detent 167 may be angled with respect to the mating plane 103 to provide additional resistance to disengagement of the detent 167 from leg 163*b*. To disengage the side latch 109, the second elongated finger 166 may be pressed inward toward the first elongated finger 165 and the interior of the first cooperating member 161. At sufficient deflection of the second free end 166*b* of the second elongated finger, detent 167 loses contact with the leg 163*b*, thus allowing the second cooperating member 162 to be withdrawn from the first cooperating member 161 with minimal resistance.

Note that the arrangement of the first elongated finger 165 parallel to and adjacent with leg 163*a* and the second elongated finger 166 parallel to and adjacent with the other leg 163*b* enables the side latch 109 to be in an unstressed state during both a latched and unlatched state. That is, elongated fingers 165,166 are only flexed or stressed during insertion of the second cooperating member into the first cooperating member. At all other times, the first and second cooperating members remain unstressed, thereby improving the reliability and durability of the side latch 109 and the enclosure 100.

In addition to the pair of side latches 109, a pair of top latches 110 (i.e., a first top latch 110*a* and a second top latch 110*b*) are provided on the enclosure 100. In contrast to the side latches 109, the top latches 110 are arranged at the top 106 of the enclosure 100, as shown in FIG. 1. The first top latch 110*a* may be provided on the top planar ledge 129 toward the front 104 of the enclosure 100 and the second top latch 110*b* may be provided on the top planar ledge 129 toward the back 105 of the enclosure. Thus, the top latches 110 serve to more rigidly and reliably hold the left half-shell 102*b* and the right half-shell 102*a* together in the vicinity of the top port 111 and the side port 112.

It is also contemplated that latches 110 may be provided in regions other than the top annular ledge 129 of the enclosure. For example, latches 110 may be provided on a portion of the enclosure at the mating plane 103 different from the cylindrical sidewall 122. Specifically, latches 110 may be provided on the tapered top member 126 or annular base member 114 in addition to, or in place of, the latches 110 provided on the top annular ledge 129.

Figure 6:
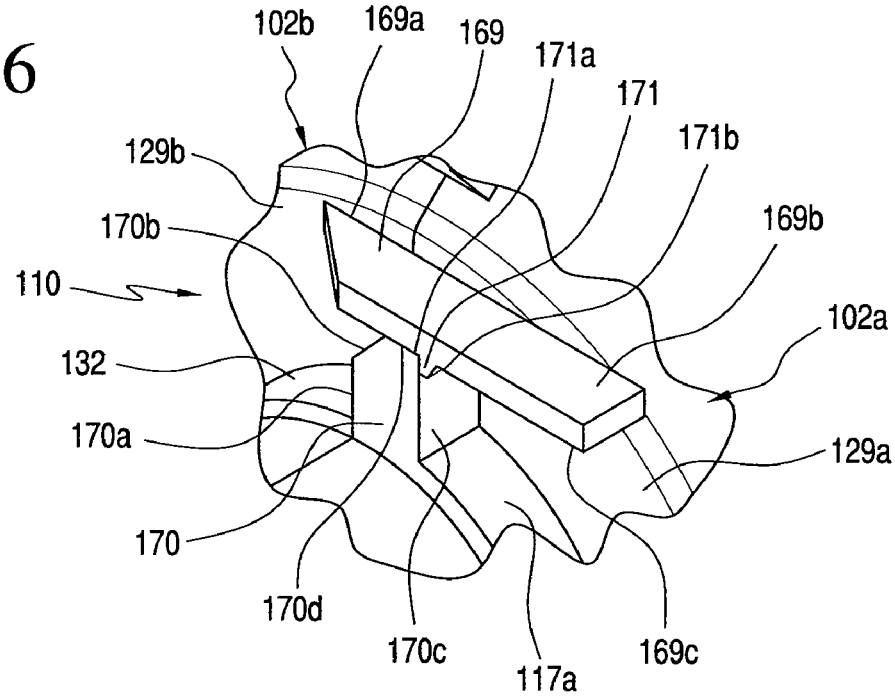
FIG. 6 is an enlarged isometric view of a top latch of the wildlife protection guard of FIG. 1.

Referring now to FIG. 6, a magnified isometric view of an embodiment of the top latch 110 in a latched position is shown. Each top latch 110 includes an elongated flexible finger 169 and a stop 170. The flexible finger 169 is formed on the left half-shell 102*b* while the stop 170 is formed on the right half-shell 102*a*. Note that the location of the flexible finger 169 and the stop 170 may be reversed without affecting the function of the top latch 110. In particular, the stop 170 may be provided on the left half-shell 102*b* and the flexible finger 169 may be provided on the right half-shell 102*a*. It is further noted that one of the pair of top latches 110 may have an opposite orientation compared to the other top latch 110, as shown in FIG. 2. That is, one top latch 110*a* may have a flexible finger 169 on the right half-shell 102*a* while the other top latch 110*b* may have a stop 170 on the right half-shell 102*a*.

The stop 170 is fixed to the second right semi-annular surface 129*a* of the right half-shell 102*a* adjacent to and in contact with a portion of the circumference of the right semi-cylindrical riser portion 117*a*. Stop 170 may be located such that front surface 170*a* is adjacent to the mating plane 103. The front surface 170*a* may have a chamfered surface 170*b* to assist in the engagement between the flexible finger 169 and the stop 170 of the top latch 110. Alternately, front surface 170*a* may be tapered, filleted, or beveled to assist in the engagement. A rear engagement surface 170*c* of the stop is arranged parallel to and spaced apart from the mating plane 103. In an alternative embodiment, engagement surface 170*c* may be angled with respect to the mating plane 103, so as to interact with a cooperatively angled surface of detent 171 of flexible finger 169.

The elongated flexible finger 169 is fixed to the second left semi-annular surface 129*b* of the left half-shell 102*b* and extending perpendicular to the mating plane 103. The elongated flexible finger 169 is spaced from the circumference of the riser 117. The elongated flexible finger 169 has a fixed end 169*a* mounted on the left half-shell 102*b* and a free end 169*b*, which extends beyond the mating plane 103.

In accordance with at least one embodiment of the present invention, the free end 169*b* has sufficient length such that it may be manipulated by hand (i.e., depressed by pressing with a finger) even when the flexible finger 169 is fully engaged with the stop 170. The flexible finger 169 includes the detent 171 provided on a surface 169*c* of the flexible finger 169 facing the stop 170. As illustrated in FIGS. 2 and 6, the detent 171 is tapered from an end of the detent 171 closest to the free end 169*b* of the flexible finger 169, to assist in engagement of the elongated finger 169 with the stop 170. In alternate embodiments, the detent 171 may instead be chamfered, filleted, or beveled. A rear engagement surface 171*a* is provided distal from the free end 169*b* for engaging with the corresponding engagement surface 170*c* of the stop 170. Note that if the engagement surface 170*c* of the stop 170 is angled, the rear surface 171*a* may also be angled so as to cooperate with the engagement surface 164. In addition, the free end 169*b* of the flexible finger 169 may be chamfered to assist in moving the flexible finger 169 with respect to the mating plane 103. That is, a chamfer may be included at the lower edge of the flexible finger 169 to assist in moving across a seam at the mating plane 103. Alternately, the free end 169*b* of the flexible finger may be rounded, filleted, or tapered.

When closing the enclosure 100, the free end 169*b* of the flexible finger 169 is initially pushed past stop 170 to cause the tapered surface of detent 171 to push on surface 170*b*. This interaction causes flexing of the flexible finger 169 away from the stop 170. As the detent 171 continues past the stop 170, detent 171 snaps into place adjacent to the stop 170. Once the detent 171 snaps into place, the flexible finger 169 is no longer flexed and the detent 171 occupies a position adjacent to and in contact with the engagement surface 170*c*. This contact effectively inhibits disengagement of the flexible finger 169 from the stop so as to latch the left half-shell 102*b* to the right half-shell 102*a*.

To disengage the top latch 110, the flexible finger 169 may be pressed at its free end 169*b* away from the stop 170 and toward being parallel to the mating plane 103. At sufficient deflection of the free end 169*b* of the flexible finger 169, detent 171 is no longer in contact with the engagement surface 170*c* of stop 170, thus allowing the flexible finger 169 to be withdrawn away from the stop 170 with minimal resistance.

Note that the arrangement of the flexible finger 169 parallel to and adjacent with surface 170*d* of the stop 170 enables the top latch 110 to be in an unstressed state during both a latched and unlatched state. That is, flexible finger 169 is only flexed or stressed during engagement of the detent 171 with the stop 170. At all other times, the flexible finger 169 and the stop remain unstressed, thereby improving the reliability and durability of the top latch 110 and the enclosure 100.

Although particular embodiments for the side latch 109 and top latch 110 have been discussed above with respect to FIGS. 6-7, other latch designs are also contemplated. Alternate side latch designs are discussed below with reference to FIGS. 8-12. Although only alternate side latch designs are treated in detail herein, these latch designs may be applied to the top latch 110 with appropriate modifications, as shown and described herein. Similarly, the designs for the top latch 110 may be applied to the side latches 109. While several latch variations are presented herein, this presentation is not intended to be exhaustive of the latch designs. Rather, other current or future latch designs as may be employed in the arts are contemplated.

Figure 8:
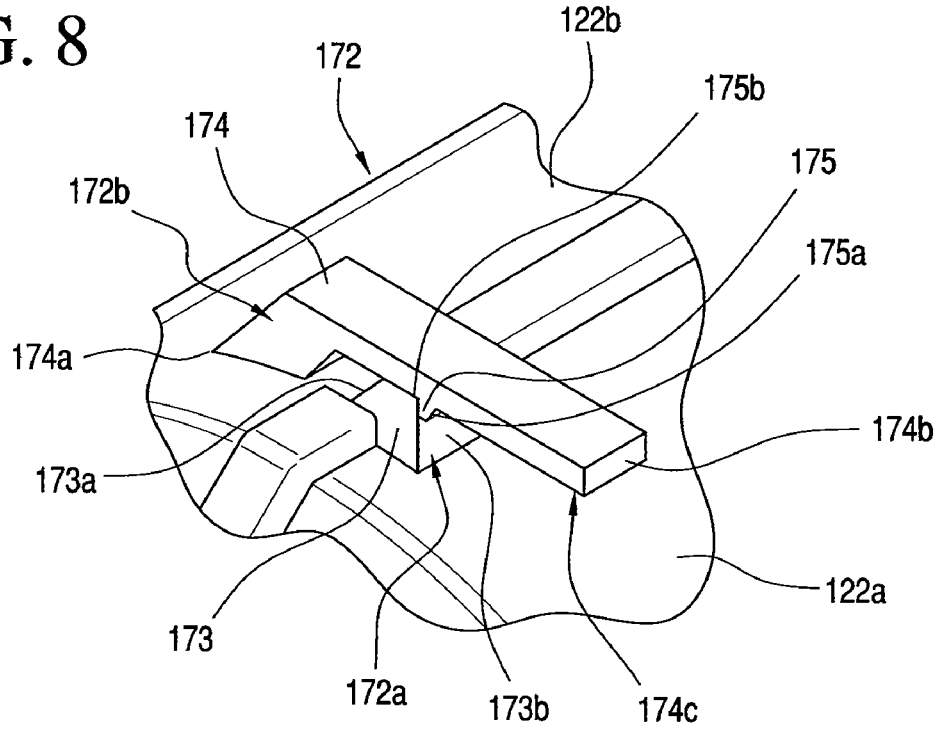
FIG. 8 is an enlarged isometric view of a first alternative side latch embodiment for use in a wildlife protection guard.

FIG. 8 shows an enlarged isometric view of an embodiment of a first alternative side latch 172. The first alternative side latch 172 is similar to the design of the top latch 110 discussed above with certain modifications. In particular, rather than being mounted on a surface perpendicular to central axis 101 (i.e., top ledge 129), the flexible finger is mounted on a surface parallel to the central axis 101 (i.e., cylindrical sidewall 122). Each side latch 172 includes a first cooperating member 172*a* and a second cooperating member 172*b*. The first cooperating member 172*a* is formed on the right half-shell 102*a* while the second cooperating member 172*b* is formed on the left half-shell 102*b*, although their orientations may be reversed, as noted above.

The first cooperating member 172*a* includes a stop 173. The stop 173 is fixed to the right semi-cylindrical sidewall 122*a* of the right half-shell 102*a*. Stop 173 may be located such that a front surface 173*a* of the stop 173 is located adjacent to the mating plane 103. The front surface 173*a* may have a chamfered surface to assist in the engagement between a flexible finger 174 and the stop 173 of the side latch 172. Alternately, the front surface 173*a* may be tapered, filleted, or beveled to assist in the engagement. A rear engagement surface 173*b* of the stop 173 is arranged parallel to and spaced apart from the mating plane 103. In an alternative embodiment, engagement surface 173*b* may be angled with respect to the mating plane 103, so as to interact with a cooperative angled surface of a detent 175 of flexible finger 174.

The second cooperating member 172*b* includes the raised flexible finger 174. The flexible finger 174 is fixed to the left semi-cylindrical sidewall 122*b* of the left half-shell 102*b* by way of a fixed base 174*a*. The flexible finger 174 thus has a cantilevered profile being supported at one end in an elevated position by fixed base 174*a* and a free end 174*b* which extends beyond the mating plane 103. The raised flexible finger 174 extends perpendicular to the mating plane 103. In one or more embodiments, the free end 174*b* has sufficient length such that it may be manipulated by hand (i.e., depressed by pressing with a finger or raised by pulling with a finger) even when the flexible finger 174 is fully engaged with the stop 173. The flexible finger 174 includes the detent 175 provided on a surface 174*c* of the flexible finger 174 facing the stop 173. The detent 175 may have a tapered surface 175*a* to assist in engagement of the elongated finger 174 with the stop 173. In alternate embodiments, the detent 175 may instead be chamfered, filleted, or beveled. A rear engagement surface 175*b* is provided distal from the free end 174*b* for engaging with the corresponding engagement surface 173*b* of the stop 173. Note that if the engagement surface 173*b* of the stop 173 is angled, the rear surface 175*b* may also be angled so as to cooperate with the engagement surface 173*b*. In addition, the free end 174*b* of the flexible finger 174 may be chamfered or beveled to assist in moving the flexible finger 174 over stop 173. Alternately, the free end 174*b* of the flexible finger may be rounded, filleted, or tapered.

When closing the enclosure 100, the free end 174*b* of the flexible finger 174 is initially pushed past stop 173 to cause the tapered surface 175*a* of detent 175 to push on surface 173*a*. This interaction causes flexing of the flexible finger 174 away from the stop 173. As the detent 175 continues past the stop 173, the detent 175 snaps into place adjacent to the stop 173. The detent 175 no longer flexes the flexible finger 174 and thus occupies a position adjacent to and in contact with the engagement surface 173*b*. This contact effectively prevents disengagement of the flexible finger 174 from the stop 173 so as to latch the left half-shell 102*b* to the right half-shell 102*a*.

To disengage the side latch 172, the flexible finger 174 may be pulled at its free end 174*b* upward and away from the stop 173 and toward being parallel to the mating plane 103. At sufficient deflection of the free end 174*b* of the flexible finger 174, detent 175 is no longer in contact with the engagement surface 173*b* of stop 173, thus allowing the flexible finger 174 to be withdrawn away from the stop 173 with minimal resistance.

Note that the height of the fixed base 174*a* of the flexible finger 174 is chosen to enable the side latch 172 to be in an unstressed state during both a latched and unlatched state. That is, flexible finger 174 is only flexed or stressed during the process of engaging the detent 175 with the stop 173. At all other times, the flexible finger 174 remains unstressed, thereby improving the reliability and durability of the side latch 172 and the enclosure 100.

Figure 9:
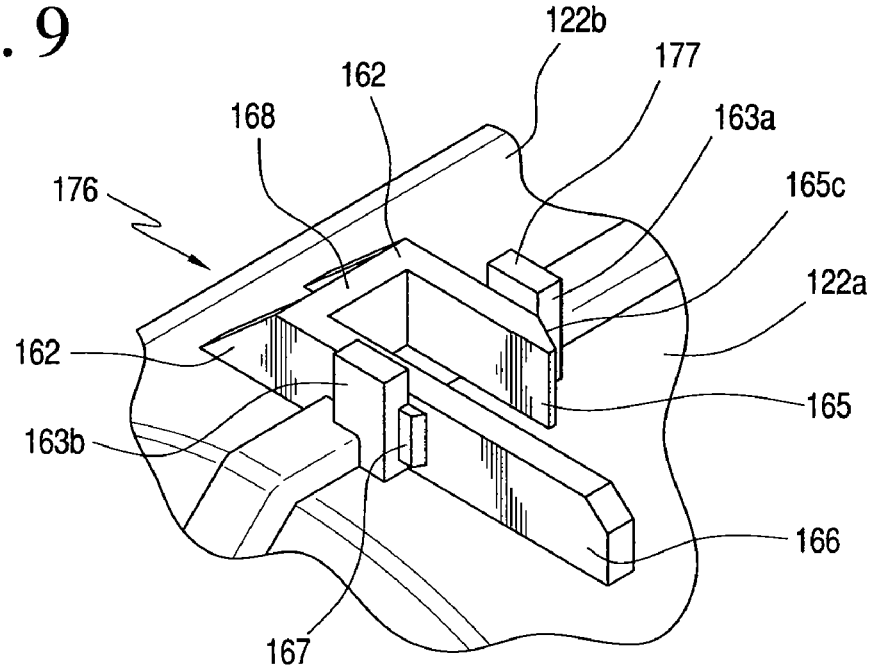
FIG. 9 is an enlarged isometric view of a second alternative side latch embodiment for use in a wildlife protection guard.

FIG. 9 is an enlarged isometric view of an embodiment of a second alternative side latch 176 in a latched position. The second alternative side latch 176 is similar to side latch 109 illustrated in FIG. 7. However, the first cooperating member 161 of side latch 109 is modified to remove crossbar 164. Thus, a first cooperating member 177 includes only a pair of legs 163*a*, 163*b*. The second cooperating member 162 remains unchanged from that of side latch 109. The structure and operation of the side latch 176 would be similar to that described above for side latch 109.

Figure 10:
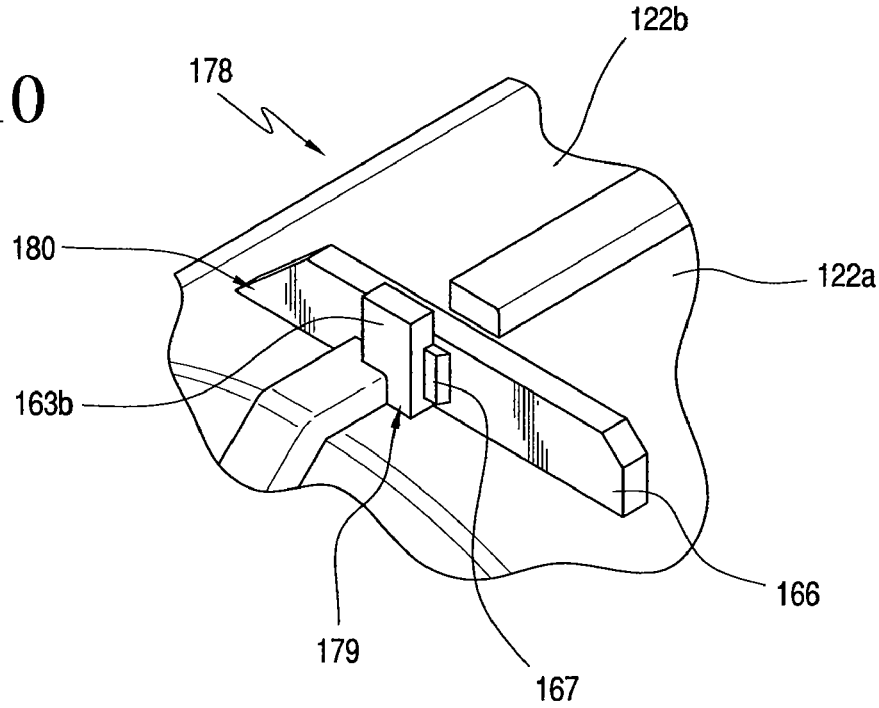
FIG. 10 is an enlarged isometric view of a third alternative side latch embodiment for use in a wildlife protection guard.

FIG. 10 is an enlarged isometric view of an embodiment of a third alternative side latch 178 in a latched position. The third alternative side latch 178 is similar to side latch 176 illustrated in FIG. 9. However, the first cooperating member 177 of side latch 176, in FIG. 9, is modified to remove leg 163*a*. Thus, a first cooperating member 179 in FIG. 10 includes only a leg 163*b*. The second cooperating member 162 of side latch 176 in FIG. 9 is also modified. Thus, a second cooperating member 180 of side latch 178 in FIG. 10 includes only the second elongated finger 166.

Thus, when closing the enclosure 100 with the third alternative side latch 178 of FIG. 10, the second free end 166*b* of the second elongated finger 166 is initially pushed past leg 163*b* to cause the detent 167 to push on leg 163*b* of the first cooperating member 179. This interaction causes flexing of the second elongated finger 166 away from leg 163*b*. As it proceeds past the leg 163*b*, detent 167 snaps into place adjacent a surface of the leg 163*b* distal from the mating plane 103. The detent 167 no longer flexes the second elongated finger 166 and thus occupies a position adjacent to and in contact with the surface of leg 163*b* distal from the mating plane 103. This contact effectively prevents disengagement of the second cooperating member 180 from the first cooperating member 179 so as to latch the left half-shell 102*b* to the right half-shell 102*a*. To disengage the side latch 178, the elongated finger 166 is pushed away from the leg 163*b* in a direction parallel to the mating plane 103 until the detent 167 is no longer in contact with the leg 163*b*. Thus, the second cooperating member 180 can be withdrawn from the first cooperating member 179 with minimal resistance.

Figure 11:
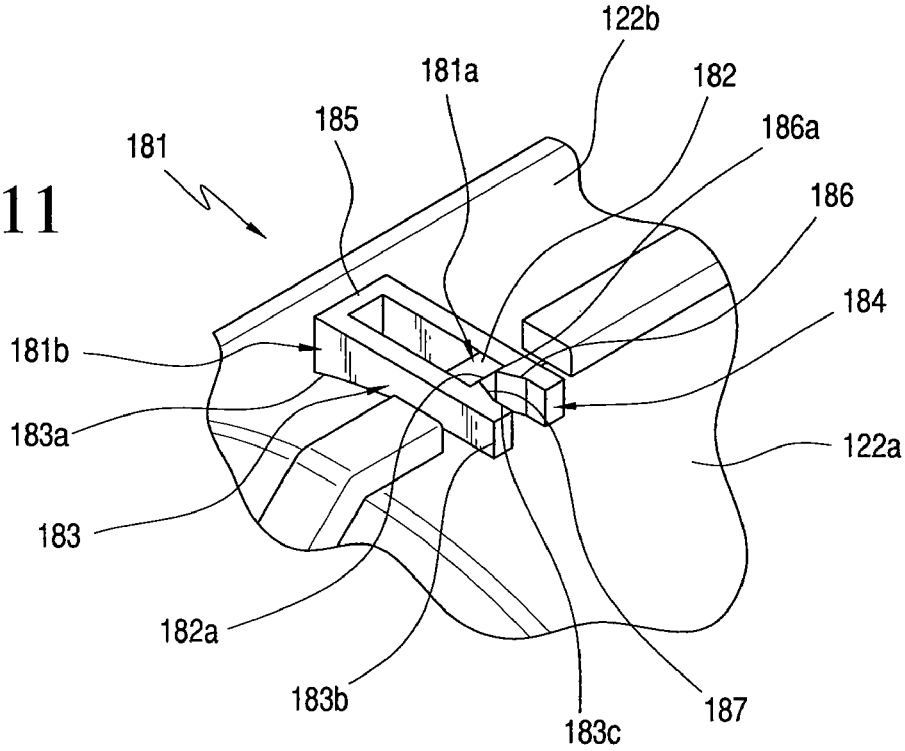
FIG. 11 is an enlarged isometric view of a fourth alternative side latch embodiment for use in a wildlife protection guard.

FIG. 11 is an enlarged isometric view of an embodiment of a fourth alternative side latch 181 in a latched position. Each side latch 181 includes a first cooperating member 181*a* and a second cooperating member 181*b*. The first cooperating member 181*a* is formed on the right half-shell 102*a* while the second cooperating member 181*b* is formed on the left half-shell 102*b*, although their orientations may be reversed, as noted above.

The first cooperating member 181*a* includes an engagement post 182 extending perpendicularly to the surface of the right semi-cylindrical sidewall 122*a* and having a surface extending parallel to the mating plane 103. The engagement post 182 may be located adjacent to the mating plane 103. Engagement post 182 generally has a rectangular cross-section, as shown in FIG. 11. However, other cross-sectional shapes are contemplated. For example, but not limited to, the engagement surface 182*a* of the engagement post 182 may be formed as a pair of angled surfaces so as to interact with cooperatively angled surfaces of the second cooperating member 181*b*.

The second cooperating member 181*b* is fixed to the left semi-cylindrical sidewall 122*b* of the left half-shell 102*b*. The second cooperating member 181*b* includes a first elongated finger 183 and a second elongated finger 184. Both fingers 183,184 extend in a direction perpendicular to the mating plane 103.

The first elongated finger 183 has a first fixed end 183*a* mounted on the left half-shell 102*b* and a first free end 183*b*, which extends beyond the mating plane 103. The first elongated finger 183 includes a tapered protrusion 186 extending from a portion of an interior surface 183*c* of the first elongated finger 183. The interior surface 183*c* may extend parallel to and be in contact with the engagement post 182 when the second cooperating member 181*b* is engaged with the first cooperating member 181*a*. The tapered protrusion 186 has a width from the interior surface 183*c* having a minimum closer to the free end 183*b* and a maximum closer to the fixed end 183*a*. The tapered protrusion terminates with a planar rear surface 186*a* parallel to the engagement surface 182*a* of the engagement post 182. Note that if the engagement surface 182*a* is angled, the rear surface 186*a* may also be angled so as to cooperate with the engagement surface 182*a*. Preferably, there is sufficient length of the first elongated finger 183 extending beyond the tapered protrusion 186 such that the second cooperating member may be manipulated by hand (i.e., depressed by pressing with a finger of flexed by pushing or pulling with a finger) even when the second cooperating member is fully inserted into the first cooperating member. In an alternate embodiment, protrusion 186 may be chamfered, filleted, or beveled instead of tapered.

Both fingers 183,184 are substantially identical mirror images of each other. Thus, the above general description of first elongated finger 183 would also apply to finger 184. The first elongated finger 183 and the second elongated finger 184 may be connected together by an optional connecting piece 185. Connecting piece 185 extends between the first elongated finger 183 and the second elongated finger 184 parallel to and spaced from the mating plane 103. The connecting piece 185 is also fixed to the left half-shell 102*b*. Between the respective tapered protrusions 186 of the first elongated finger 183 and the second elongated finger 184 is a gap 187. Note that the width of the gap 187 in a direction parallel to the mating plane should be less than a corresponding width of the engagement surface 182*a* of the engagement post 182.

When closing the enclosure, the second cooperating member 181*b* is pushed towards the mating plane 103 to engage with the first cooperating member 181*a*. The free ends of the first and second elongated fingers 183,184 are in contact with the engagement post 182 at their respective protrusions 186. As the second cooperating member 181*b* is further pushed, contact of the protrusions 186 with the sides of the engagement post 182 urge the first and second elongated fingers 183,184 away from each other. The second cooperating member 181*b* reaches its latched position when the rear surface 186*a* of each protrusion proceeds past the side surfaces of the engagement post 182. As the rear surfaces 186*a* proceed past the engagement post 182, the protrusions 186 snap into place adjacent to the engagement surface 182*a*, which is distal from the mating plane 103. The protrusions 186 no longer flex their respective elongated fingers 183,184 and thus occupy a position adjacent to and in contact with the engagement surface 182*a* of the engagement post 182. This contact effectively inhibits disengagement of the second cooperating member 181*b* from the first cooperating member 181*a* so as to latch the left half-shell 102*b* to the right half-shell 102*a*. To disengage the side latch 181, each elongated finger 183,184 is simultaneously pushed away from each other until the gap 187 between the protrusions is greater than the width of the engagement surface 182*a* of the engagement post 182, thus allowing the second cooperating member to be withdrawn from the first cooperating member with minimal resistance.

Figure 12:
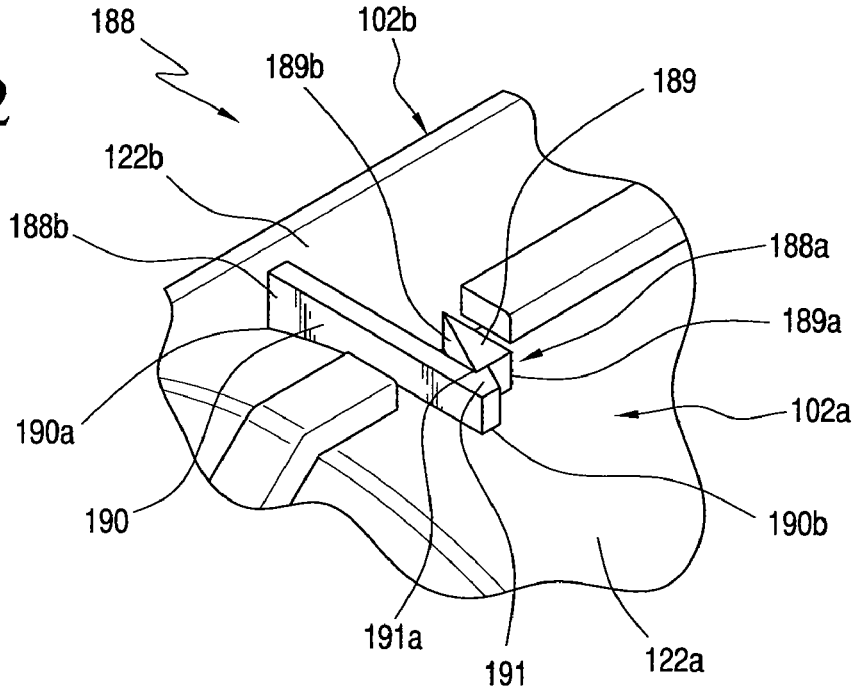
FIG. 12 is an enlarged isometric view of a fifth alternative side latch embodiment for use in a wildlife protection guard.

FIG. 12 is an enlarged isometric view of an embodiment of a fifth alternative side latch 188 in a latched position. Each side latch 188 includes a first cooperating member 188*a* and a second cooperating member 188*b*. The first cooperating member 188*a* is formed on the right half-shell 102*a* while the second cooperating member 188*b* is formed on the left half-shell 102*b*, although their orientations may be reversed, as noted above.

The first cooperating member 188*a* includes an engagement post 189 extending perpendicularly to the surface of the right semi-cylindrical sidewall 122*a* and having an engagement surface 189*a* extending parallel to and distal from the mating plane 103. The engagement post 189 may be located adjacent to the mating plane 103. The engagement post 189 generally has a triangular cross-section, as shown in FIG. 12. However, other cross-sectional shapes are contemplated. For example, the engagement surface 189*a* of the engagement post 189 may be formed as a pair of angled surfaces so as to interact with cooperative angled surfaces of the second cooperating member 188*b*. The engagement post 189 also has a surface 189*b* angled with respect to the mating plane 103, so as to assist in the engagement of the second cooperating member 188*b* with the first cooperating member 188*a*.

The second cooperating member 188*b* is fixed to the left semi-cylindrical sidewall 122*b* of the left half-shell 102*b*. The second cooperating member 188*b* includes a first elongated finger 190 extending in a direction perpendicular to the mating plane 103. The first elongated finger 190 has a first fixed end 190*a* mounted on the left half-shell 102*b* and a first free end 190*b*, which extends beyond the mating plane 103. The first elongated finger 190 includes a tapered protrusion 191 extending from the first free end 190*b* in a direction parallel to the mating plane 103. The tapered protrusion 191 is located at the free end 190*b*, such that the free end 190*b* has a tapered profile with a minimum width at the free end 190*b*. The tapered protrusion 191 terminates with a planar rear surface 191*a* parallel to the engagement surface 189*a* of the engagement post 189. Note that if the engagement surface 189*a* is angled, the rear surface 191*a* may also be angled so as to cooperate with the engagement surface 189*a*. In an alternative embodiment, there may be sufficient length of the first elongated finger 190 extending beyond the tapered protrusion 191 such that the second cooperating member may be manipulated by hand (i.e., depressed by pressing and/or pulling with a finger) even when the second cooperating member is fully inserted into the first cooperating member. In an alternate embodiment, protrusion 191 may be chamfered, filleted, or beveled instead of tapered.

When closing the enclosure, the second cooperative member 188*b* is pushed towards the mating plane 103 to engage with the first cooperating member 188*a*. Protrusion 191 on the elongated finger 190 contacts surface 189*b* of the engagement post 189. As the second cooperating member 188*b* is pushed further towards the mating plane, contact of the protrusion 191 with surface 189*b* of the engagement post 189 urges the elongated finger 190 away from the engagement post 189. The second cooperating member 188*b* reaches its latched position when the rear surface 191*a* of the protrusion 191 proceeds past the surface 189*b* of the engagement post 189. As the rear surface 191*a* proceeds past the engagement post 189, the protrusion 191 snaps into place with its rear surface 191 adjacent to the engagement surface 189*a*. The elongated finger 190 is no longer flexed such that the protrusion 191 occupies a position adjacent to and in contact with the engagement surface 189*a* of the engagement post 189. This contact effectively prevents disengagement of the second cooperating member 188*b* from the first cooperating member 188*a* so as to latch the left half-shell 102*b* to the right half-shell 102*a*. To disengage the side latch 188, the elongated finger 190 is pushed away from the engagement post 189 in a direction parallel to the mating plane 103 until the rear surface 191*a* of the protrusion 191 is no longer in contact with the engagement surface 189*a* of the engagement post 189. Thus, the second cooperating member 188*b* can be withdrawn from the first cooperating member 188*a* with minimal resistance.

As described above, the left half-shell 102*b* and right half-shell 102*a* are held together along the back 105 side of the enclosure 100 by a pair of hinges 108 while the front 104 side is held closed by a pair of side latches 109. Thus, hinges 108 and side latches 109 are mounted on opposite sides of the enclosure at the mating plane 103. The hinges 108 allow the half-shells 102*a*, 102*b* to rotate with respect to each other about an axis defined by the hinges 108.

The right half-shell 102*a* and left half-shell 102*b* contact each other along a seam defined by the mating plane 103. For example, the right half-shell 102*a* has a front mating surface 192*a* on the right semi-cylindrical sidewall 122*a*, a back mating surface 193*a* on the right semi-cylindrical sidewall 122*a*, a bottom mating surface 195*a* on the right semi-annular base member 114*a* and right semi-cylindrical riser 117*a*, and a top mating surface 194*a* on the right tapered surface 126*a*, the right semi-annular surface 129*a*, the right portion of the top port 111, and the right portion of the side port 112. Similarly, the left half-shell 102*b* has a front mating surface 192*b* on the left semi-cylindrical sidewall 122*b*, a back mating surface 193*b* on the left semi-cylindrical sidewall 122*b*, a bottom mating surface 195*b* on the left semi-annular base member 114*b* and left semi-cylindrical riser 117*b*, and a top mating surface 194*b* on the left tapered surface 126*b*, the left semi-annular surface 129*b*, the left portion of the top port 111, and the left portion of the side port 114. When assembled and in a closed-configuration, the respective mating surfaces are aligned and in contact. That is, front mating surfaces 192*a* and 192*b* are aligned and in contact, back mating surfaces 193*a* and 193*b* are aligned and in contact, bottom mating surfaces 195*a* and 195*a* are aligned and in contact, and top mating surfaces 194*a* and 194*b* are aligned and in contact. The juxtaposed mating surfaces thus define a seam coplanar with the mating plane 103 and extending along the entire periphery of the enclosure 100.

To protect the interior of the enclosure 100 from the intrusion of elements and/or animals along the seam, the half-shells may be flanged by providing an over-hanging lip portion, an under-hanging lip portion, or both to cover various exposed portions of the seam when the enclosure is in a closed and assembled configuration. For example, with reference to FIGS. 1 and 5, the right half-shell 102*a* may be provided with over-hanging lip portions 196*a* which may cover various exposed portions of the seam. Similarly, the left half-shell 102*b* may be provided with over-hanging lip portions 196*b* which cover various other exposed portions of the seam. Regions of the seam that are not amenable to an over-hanging lip portion may be covered by an under-hanging lip portion. For example, because latches 109 are located on the exterior of cylindrical sidewall of the enclosure at the mating plane, an overhanging lip, generally, cannot be provided in these regions. Instead, an under-hanging lip, which covers the seam from the interior of the enclosure 100, may be provided underneath the latches 109. As shown in FIG. 2, the top planar ledge 129 is not provided with an over-hanging lip portion to cover the exposed seam. However, the exposed seam in this region may be provided with an over-hanging lip portion or under-hanging lip portion, as described above. It is also noted that not all portions of the exposed seam need to be covered by an over-hanging or under-hanging lip portion.

Although particular geometries for the various components of the enclosure have been discussed in the above description and illustrated in the figures referenced therein, it is contemplated that other geometries may be employed for the various components. For example, base member 114, first central opening 115, and second central opening 121 may be substantially polygonal. Alternately, only a portion of the components of the base member 114 may have a substantially circular cross-section. For example, base member 114 and first central opening 115 may be substantially polygonal whereas the length and direction of each finger 119 may be configured to define a substantially circular second central opening 121. In another example, rather than extending orthogonal to the base member 114, sidewall 122 may extend at an oblique angle with respect to the base member 114. In another example tapered top member 126 may have a non-circular cross-section. Thus, instead of a truncated cone, tapered top member 126 may have a tapered surface with a non-circular cross-section which decreases as it extends away from the base member 114. It is further noted that the intersection between various components of the wildlife protection guard described herein could be squared, rounded, or chamfered, as desired. Accordingly, the wildlife protection guard of the present invention is not limited to the specific shapes for the various components discussed herein.

The wildlife protection guard of the present invention could be made of any suitable material such as a plastic or formed of an insulative composite material. For example, the wildlife protection guard shown in the attached figures can be made of molded plastic formed by an injection molding process. The molded plastic may include ABS plastic (ABS, acrylonitrile-butadiene-styrene), PVC plastic (PVC, polyvinylchloride), or any other suitable plastic.

It is contemplated that the first half-shell and the second half-shell may be separately molded by a polymer molding process and assembled together by engaging the first hinge portion 141 to the second hinge portion 142. However, other methods of fabrication and assembly are contemplated. For example, embodiments of the present invention may be constructed as several components assembled together rather than using a left half-shell and a right half-shell. The latch mechanisms and hinge mechanisms described herein may be attached to their respective half-shells after molding. Thus, the left and right half-shells could be molded as identical mirror-image parts, thereby allowing a single mold to be used for both the left and right half-shells. Attachment of the latch and hinge mechanisms to their respective half-shells may be accomplished by a variety of including, but not limited to welding, gluing, epoxying, solvent-bonding, fastening (e.g., screws, bolts, etc.), etc.

In accordance with at least one embodiment of the present invention, a wildlife protection guard adapted to surround a power line connection for electrical power distribution equipment including an enclosure having a central axis and formed by a first half-shell and a second half-shell. The first and second half-shells are defined by a mating plane bisecting the enclosure parallel to the central axis. The enclosure of the wildlife protection guard further including a base member coaxially aligned with the central axis and having a first central opening therein, the base member having a first inner edge defining said first central opening and a first outer edge.

The enclosure of the wildlife protection guard further including a first sidewall coaxially aligned with the central axis and having a first top edge and a first bottom edge, the first bottom edge being adjacent to the first outer edge of the base member, the first sidewall extending in a direction from the first bottom edge to the first top edge. The enclosure of the wildlife protection guard further including a tapered member coaxially aligned with the central axis and having a second top edge, a second bottom edge, and a tapered sidewall extending from the second bottom edge to the second top edge. The second bottom edge is adjacent to the first top edge of the first sidewall. The tapered sidewall has a larger cross-section at the second bottom edge than at the second top edge. The enclosure of the wildlife protection guard further including a top member coaxially aligned with the central axis and having a second central opening therein. The top member has a second inner edge defining the second central opening and a second outer edge adjacent to the second top edge of the tapered member. The second central opening defines a first port. The enclosure of the wildlife protection guard further including a sidewall opening formed in the tapered sidewall of the tapered member at a location between the second top edge and the second bottom edge, the sidewall opening being bisected by the mating plane and defining a second port. The enclosure of the wildlife protection guard still further including at least one first latch provided on the first sidewall at the mating plane on a first side of the enclosure and at least one second latch provided on a portion of the enclosure at the mating plane different from the first sidewall. The enclosure of the wildlife protection guard still further including at least one hinge provided on the first sidewall at the mating plane on a second side of the enclosure opposite to the first side of the enclosure. The at least one hinge includes at least two hinge posts supported by one of the first half-shell and the second half-shell and a cylindrical hinge pin supported by the other of the first half-shell and the second half-shell. Each hinge post has a semi-arcuate engagement portion. The at least two hinge posts are arranged such that the respective engagement portions are in an offset, opposing configuration so as to be able to rotatably embrace the hinge pin between the engagement portions.

In accordance with one or more embodiments of the present invention, a wildlife protection guard adapted to surround a power line connection for electrical power distribution systems including an enclosure. The enclosure includes a central axis. The enclosure is formed by a first half-shell and a second half-shell. The first and second half-shells are defined by a mating plane bisecting the enclosure parallel to the central axis. The enclosure further includes a base member coaxially aligned with the central axis and having a first central opening therein. The base member has a first inner edge defining said first central opening and a first outer edge. The enclosure further includes a first sidewall coaxially aligned with the central axis and having a first top edge and a first bottom edge. The first bottom edge is adjacent to the first outer edge of the base member. The first sidewall extends in a direction from the first bottom edge to the first top edge. The enclosure further includes a tapered member coaxially aligned with the central axis and having a second top edge, a second bottom edge and a tapered sidewall extending from the second bottom edge to the second top edge. The second bottom edge is adjacent to the first top edge of the first sidewall. The tapered sidewall has a larger cross-section at the second bottom edge than at the second top edge. The enclosure further includes a top member coaxially aligned with the central axis and having a second central opening therein. The top member has a second inner edge defining the second central opening and a second outer edge adjacent to the second top edge of the tapered member. The second central opening defines a first port. The enclosure further includes a sidewall opening formed in the tapered sidewall of the tapered member at a location between the second top edge and the second bottom edge. The sidewall opening is bisected by the mating plane and defines a second port. The enclosure further includes a third riser coaxially aligned with the sidewall opening in the tapered sidewall and having a fifth top edge and fifth bottom edge. The third riser has a length from the fifth bottom edge to the fifth top edge which varies along a perimeter of the third riser. The length has a maximum value for points on the fifth top edge of the third riser coincident with the mating plane and a minimum value for points on the fifth top edge of the third riser farthest from the mating plane. The points on the fifth top edge of the third riser coincident with the mating plane define a second line coplanar with the mating plane and parallel to tapered sidewall. The enclosure further comprises a plurality of flexible fingers extending from the fourth top edge toward the mating plane and terminating at said second line. The enclosure further includes at least one first latch provided on the first sidewall at the mating plane on a first side of the enclosure and at least one second latch provided on a portion of the enclosure at the mating plane different from the first sidewall. The enclosure still further includes at least one hinge provided on the first sidewall at the mating plane on a second side of the enclosure opposite to the first side of the enclosure. The at least one hinge includes at least two hinge posts supported by one of the first half-shell and the second half-shell and a cylindrical hinge pin supported by the other of the first half-shell and the second half-shell. Each hinge post has a semi-arcuate engagement portion. The at least two hinge posts are arranged such that the respective engagement portions are in an offset, opposing configuration so as to be able to rotatably embrace the hinge pin between the engagement portions. The first half-shell and the second half-shell are configured to be separately molded by a polymer molding process and assembled together by engaging the at least two hinge posts of the at least one hinge with the cylindrical hinge pin. The first half-shell and the second half-shell contact each other along a seam defined by the mating plane with at least a portion of the seam protected by an overhanging lip of one of the first half-shell and the second half-shell when the enclosure is in a closed and assembled configuration.

In accordance with one or more embodiments of the present invention, a wildlife protection guard adapted to surround a power line connection for electrical power distribution systems including an enclosure. The enclosure includes a central axis. The enclosure is formed by a first half-shell and a second half-shell. The first and second half-shells are defined by a mating plane bisecting the enclosure parallel to the central axis. The enclosure further includes a base member coaxially aligned with the central axis and having a first central opening therein. The base member has a first inner edge defining said first central opening and a first outer edge. The enclosure further includes a first sidewall coaxially aligned with the central axis and having a first top edge and a first bottom edge. The first bottom edge is adjacent to the first outer edge of the base member. The first sidewall extends in a direction from the first bottom edge to the first top edge. The enclosure further includes a tapered member coaxially aligned with the central axis and having a second top edge, a second bottom edge and a tapered sidewall extending from the second bottom edge to the second top edge. The second bottom edge is adjacent to the first top edge of the first sidewall. The tapered sidewall has a larger cross-section at the second bottom edge than at the second top edge. The enclosure further includes a top member coaxially aligned with the central axis and having a second central opening therein. The top member has a second inner edge defining said second central opening and a second outer edge adjacent to the second top edge of the tapered member. The second central opening defines a first port. The enclosure further includes a first riser coaxially aligned with the central axis and having a third top edge and a third bottom edge. The enclosure still further includes a second riser coaxially aligned with the central axis and having a fourth top edge and fourth bottom edge. The fourth bottom edge is adjacent to the third top edge. The second riser has a length from the fourth bottom edge to the fourth top edge which varies along a perimeter of the second riser. The length has a maximum value for points on the fourth top edge of the second riser coincident with the mating plane and a minimum value for points on the fourth top edge of the second riser farthest from the mating plane. The points on the fourth top edge of the second riser are coincident with the mating plane and define a first line coplanar with the mating plane and parallel to the top member. The enclosure further includes a first plurality of flexible fingers extending from the fourth top edge toward the mating plane and terminating at said first line. The enclosure further includes a sidewall opening formed in the tapered sidewall of the tapered member at a location between the second top edge and the second bottom edge. The sidewall opening is bisected by the mating plane and defines a second port. The enclosure further includes a third riser coaxially aligned with the sidewall opening in the tapered sidewall and having a fifth top edge and fifth bottom edge. The third riser has a second length from the fifth bottom edge to the fifth top edge which varies along a perimeter of the third riser. The third riser length has a maximum value for points on the fifth top edge of the third riser coincident with the mating plane and a minimum value for points on the fifth top edge of the third riser farthest from the mating plane. The points on the fifth top edge of the third riser coincident with the mating plane define a second line coplanar with the mating plane and parallel to the tapered sidewall. The enclosure further includes a second plurality of flexible fingers extending from the fourth top edge toward the mating plane and terminating at said second line. The enclosure still further includes at least one first latch provided on the first sidewall at the mating plane on a first side of the enclosure and a pair of second latches provided on opposite portions of the top member at the mating plane. The enclosure further includes at least one hinge provided on the first sidewall at the mating plane on a second side of the enclosure opposite to the first side of the enclosure. The at least one hinge includes at least two hinge posts supported by one of the first half-shell and the second half-shell and a cylindrical hinge pin supported by the other of the first half-shell and the second half-shell. Each hinge post has a semi-arcuate engagement portion. The at least two hinge posts are arranged such that the respective engagement portions are in an offset, opposing configuration so as to be able to rotatably embrace the hinge pin between the engagement portions.

In accordance with one or more embodiments of the present invention, a wildlife protection guard adapted to surround a power line connection for electrical power distribution equipment including an enclosure with a central axis and formed by a first half-shell and a second half-shell. The first and second half-shells are defined by a mating plane bisecting the enclosure parallel to the central axis. The enclosure of the wildlife protection guard further including a base member coaxially aligned with the central axis and having a first central opening therein, the base member having a first inner edge defining said first central opening and a first outer edge. The enclosure of the wildlife protection guard further including a first sidewall coaxially aligned with the central axis and having a first top edge and a first bottom edge, the first bottom edge being adjacent to the first outer edge of the base member, the first sidewall extending in a direction from the first bottom edge to the first top edge. The enclosure of the wildlife protection guard further including a tapered member coaxially aligned with the central axis and having a second top edge, a second bottom edge, and a tapered sidewall extending from the second bottom edge to the second top edge. The second bottom edge is adjacent to the first top edge of the first sidewall. The tapered sidewall has a larger cross-section at the second bottom edge than at the second top edge. The enclosure of the wildlife protection guard further including a top member coaxially aligned with the central axis and having a second central opening therein. The top member has a second inner edge defining said second central opening and a second outer edge adjacent to the second top edge of the tapered member. The second central opening defines a first port. The enclosure of the wildlife protection guard further including a sidewall opening formed in the tapered sidewall of the tapered member at a location between the second top edge and the second bottom edge, the sidewall opening being bisected by the mating plane and defining a second port. The enclosure of the wildlife protection guard still further including at least one first latch provided on the first sidewall at the mating plane on a first side of the enclosure and at least one second latch provided on a portion of the enclosure at the mating plane different from the first sidewall. The enclosure of the wildlife protection guard still further including means for rotatably attaching the first half-shell to the second half-shell.

The means for rotatably attaching the first half-shell to the second half-shell may include at least one hinge provided on the first sidewall at the mating plane. The at least one hinge may further include at least two hinge posts supported by one of the first half-shell and the second half-shell and a cylindrical hinge pin supported by the other of the first half-shell and the second half-shell. Each hinge post may have a semi-arcuate engagement portion. The at least two hinge posts may be arranged such that the respective engagement portions are in an offset, opposing configuration so as to be able to rotatably embrace the hinge pin between the engagement portions.

In accordance with one or more embodiments of the present invention, a wildlife protection guard as substantially shown and described herein.

As is apparent from the above description and the figures referenced therein, there is provided a wildlife protection guard in accordance with the present invention. While this invention has been described in conjunction with a number of embodiments, the invention is not to be limited to the description of the embodiment contained herein, but rather is defined by the claims appended hereto and their equivalents. It is further evident that many alternatives, modifications, and variations would be, or are, apparent to those of ordinary skill in the applicable arts. Accordingly, Applicants intend to embrace all such alternatives, modifications, equivalents, and variations that are within the spirit and scope of this invention.

What is claimed is:

1. A wildlife protection guard adapted to surround a power line connection for electrical power distribution systems comprising:

an enclosure having a central axis and formed by a first half-shell and a second half-shell, the first and second half-shells defined by a mating plane bisecting the enclosure parallel to the central axis;

a base member coaxially aligned with the central axis and having a first central opening therein, the base member having a first inner edge defining said first central opening and a first outer edge;

a first sidewall coaxially aligned with the central axis and having a first top edge and a first bottom edge, the first bottom edge being adjacent to the first outer edge of the base member, the first sidewall extending in a direction from the first bottom edge to the first top edge;

a tapered member coaxially aligned with the central axis and having a second top edge, a second bottom edge and a tapered sidewall extending from the second bottom edge to the second top edge, the second bottom edge being adjacent to the first top edge of the first sidewall, the tapered sidewall having a larger cross-section at the second bottom edge than at the second top edge;

a top member coaxially aligned with the central axis and having a second central opening therein, the top member having a second inner edge defining said second central opening and a second outer edge adjacent to the second top edge of the tapered member, the second central opening defining a first port;

a sidewall opening formed in the tapered sidewall of the tapered member at a location between the second top edge and the second bottom edge, the sidewall opening being bisected by the mating plane and defining a second port;

at least one first latch provided on the first sidewall at the mating plane on a first side of the enclosure;

at least one second latch provided on a portion of the enclosure at the mating plane different from the first sidewall; and at least one hinge provided on the first sidewall at the mating plane on a second side of the enclosure opposite to the first side of the enclosure, wherein the at least one hinge includes at least two hinge posts supported by one of the first half-shell and the second half-shell and a cylindrical hinge pin supported by the other of the first half-shell and the second half-shell, each hinge post has a semi-arcuate engagement portion, and the at least two hinge posts are arranged such that the respective engagement portions are in an offset, opposing configuration so as to be able to rotatably embrace the hinge pin between the engagement portions.

2. The wildlife protection guard of claim 1, wherein each hinge post has a top end distal from the first sidewall, a bottom end proximal to the first sidewall, and an interior surface extending from the bottom end to the top end and having the engagement portion therein, and the top end of each hinge post is chamfered at least at the interior surface.

3. The wildlife protection guard of claim 1, further comprising a first plurality of flexible fingers extending radially inwardly from a region proximal to the first inner edge of the base member toward and terminating short of the central axis.

4. The wildlife protection guard of claim 3, wherein the first plurality of flexible fingers extends in a plane parallel to the base member.

5. The wildlife protection guard of claim 1, further comprising:

a first riser coaxially aligned with the central axis and having a third top edge and a third bottom edge;

a second riser coaxially aligned with the central axis and having a fourth top edge and fourth bottom edge, the fourth bottom edge connected to the third top edge, the second riser having a first length from the fourth bottom edge to the fourth top edge which varies along a perimeter of the second riser, said first length having a maximum value for points on the fourth top edge of the second riser coincident with the mating plane and a minimum value for points on the fourth top edge of the second riser farthest from the mating plane, the points on the fourth top edge of the second riser coincident with the mating plane defining a first line coplanar with the mating plane and parallel to the top member; and a second plurality of flexible fingers extending from the fourth top edge toward the mating plane and terminating at said first line.

6. The wildlife protection guard of claim 1, wherein the at least one second latch is provided on the top member at the mating plane.

7. The wildlife protection guard of claim 6, wherein the at least one second latch includes two second latches provided on opposite portions of the top member.

8. The wildlife protection guard of claim 6, wherein the at least one second latch includes:

a flexible elongated member provided on the top member of one of the first half-shell and the second half-shell, extending in a direction parallel to the top member, and having a detent; and a stop disposed on the other of the first half-shell and the second half-shell; and the detent is configured to cooperate with the stop to prevent movement of the first half-shell and second half-shell away from each other.

9. The wildlife protection guard of claim 1, wherein the at least two hinge posts includes three hinge posts, one of the three hinge posts is arranged such that the engagement portion of said one of the three hinge posts is arranged in an opposing configuration to the engagements portions of the other two hinge posts.

10. The wildlife protection guard of claim 9, wherein each hinge post has a top end distal from the first sidewall, a bottom end proximal to the first sidewall, and an interior surface extending from the bottom end to the top end and having the engagement portion therein, and the top end of each hinge post is chamfered at least at the interior surface.

11. The wildlife protection guard of claim 9, wherein said other two hinge posts are connected to each other by a connecting portion spaced from the interior surfaces of the two hinge posts.

12. The wildlife protection guard of claim 9, wherein the cylindrical hinge pin has a first end portion, a middle portion, and a second end portion, the engagement portion of said one of the three hinge posts contacts substantially the first end portion, and the engagement portions of said other two hinge posts contact substantially the middle portion and the second end portion, respectively.

13. The wildlife protection guard of claim 1, wherein the engagement portions of the at least two hinge pins together embrace less than a total circumference of the cylindrical hinge pin.

14. The wildlife protection guard of claim 1, wherein the enclosure is constructed so as to allow the base member to be passed over a bushing skirt of the power line connection without modification or damage to the wildlife protection guard or the bushing skirt.

15. The wildlife protection guard of claim 1, wherein each of the first port and the second port are constructed so as to allow the passage of conductors therethrough.

16. The wildlife protection guard of claim 1, wherein the first half-shell and the second half-shell are configured to be separately molded by a polymer molding process and assembled together by engaging the at least two hinge posts of the at least one hinge with the cylindrical hinge pin.

17. The wildlife protection guard of claim 1, wherein the first half-shell and the second half-shell contact each other along a seam defined by the mating plane, and at least a portion of the seam is protected by an overhanging lip of one of the first half-shell and the second half-shell when the enclosure is in a closed and assembled configuration.

18. The wildlife protection guard of claim 17, wherein an under-hanging lip of one of the first half-shell and the second half-shell covers at least a portion of said seam in an interior of the enclosure when the enclosure is in a closed and assembled configuration.

19. The wildlife protection guard of claim 1, further comprising:

a third riser coaxially aligned with the sidewall opening in the tapered sidewall and having a fifth top edge and fifth bottom edge, the third riser having a second length from the fifth bottom edge to the fifth top edge which varies along a perimeter of the third riser, said second length having a maximum value for points on the fifth top edge of the third riser coincident with the mating plane and a minimum value for points on the fifth top edge of the third riser farthest from the mating plane, the points on the fifth top edge of the third riser coincident with the mating plane defining a second line coplanar with the mating plane and parallel to tapered sidewall; and a third plurality of flexible fingers extending from the fourth top edge toward the mating plane and terminating at said second line.

20. A wildlife protection guard adapted to surround a power line connection for electrical power distribution systems comprising:

an enclosure having a central axis and formed by a first half-shell and a second half-shell, the first and second half-shells defined by a mating plane bisecting the enclosure parallel to the central axis;

a base member coaxially aligned with the central axis and having a first central opening therein, the base member having a first inner edge defining said first central opening and a first outer edge;

a first sidewall coaxially aligned with the central axis and having a first top edge and a first bottom edge, the first bottom edge being adjacent to the first outer edge of the base member, the first sidewall extending in a direction from the first bottom edge to the first top edge;

a tapered member coaxially aligned with the central axis and having a second top edge, a second bottom edge and a tapered sidewall extending from the second bottom edge to the second top edge, the second bottom edge being adjacent to the first top edge of the first sidewall, the tapered sidewall having a larger cross-section at the second bottom edge than at the second top edge;

a top member coaxially aligned with the central axis and having a second central opening therein, the top member having a second inner edge defining said second central opening and a second outer edge adjacent to the second top edge of the tapered member, the second central opening defining a first port;

a sidewall opening formed in the tapered sidewall of the tapered member at a location between the second top edge and the second bottom edge, the sidewall opening being bisected by the mating plane and defining a second port;

a riser coaxially aligned with the sidewall opening in the tapered sidewall and having a third top edge and third bottom edge, the riser having a first length from the third bottom edge to the third top edge which varies along a perimeter of the riser, said first length having a maximum value for points on the third top edge of the riser coincident with the mating plane and a minimum value for points on the third top edge of the riser farthest from the mating plane, the points on the third top edge of the riser coincident with the mating plane defining a first line coplanar with the mating plane and parallel to tapered sidewall;

a plurality of flexible fingers extending from the third top edge toward the mating plane and terminating at said first line, at least one first latch provided on the first sidewall at the mating plane on a first side of the enclosure;

at least one second latch provided on a portion of the enclosure at the mating plane different from the first sidewall; and at least one hinge provided on the first sidewall at the mating plane on a second side of the enclosure opposite to the first side of the enclosure, wherein the at least one hinge includes at least two hinge posts supported by one of the first half-shell and the second half-shell and a cylindrical hinge pin supported by the other of the first half-shell and the second half-shell, each hinge post has a semi-arcuate engagement portion, the at least two hinge posts are arranged such that the respective engagement portions are in an offset, opposing configuration so as to be able to rotatably embrace the hinge pin between the engagement portions, the first half-shell and the second half-shell are configured to be separately molded by a polymer molding process and assembled together by engaging the at least two hinge posts of the at least one hinge with the cylindrical hinge pin, and the first half-shell and the second half-shell contact each other along a seam defined by the mating plane with at least a portion of the seam protected by an overhanging lip of one of the first half-shell and the second half-shell when the enclosure is in a closed and assembled configuration.

21. A wildlife protection guard adapted to surround a power line connection for electrical power distribution systems comprising:

an enclosure having a central axis and formed by a first half-shell and a second half-shell, the first and second half-shells defined by a mating plane bisecting the enclosure parallel to the central axis;

a base member coaxially aligned with the central axis and having a first central opening therein, the base member having a first inner edge defining said first central opening and a first outer edge;

a first sidewall coaxially aligned with the central axis and having a first top edge and a first bottom edge, the first bottom edge being adjacent to the first outer edge of the base member, the first sidewall extending in a direction from the first bottom edge to the first top edge;

a tapered member coaxially aligned with the central axis and having a second top edge, a second bottom edge and a tapered sidewall extending from the second bottom edge to the second top edge, the second bottom edge being adjacent to the first top edge of the first sidewall, the tapered sidewall having a larger cross-section at the second bottom edge than at the second top edge;

a top member coaxially aligned with the central axis and having a second central opening therein, the top member having a second inner edge defining said second central opening and a second outer edge adjacent to the second top edge of the tapered member, the second central opening defining a first port;

a first riser coaxially aligned with the central axis and having a third top edge and a third bottom edge;

a second riser coaxially aligned with the central axis and having a fourth top edge and fourth bottom edge, the fourth bottom edge connected to the third top edge, the second riser having a first length from the fourth bottom edge to the fourth top edge which varies along a perimeter of the second riser, said first length having a maximum value for points on the fourth top edge of the second riser coincident with the mating plane and a minimum value for points on the fourth top edge of the second riser farthest from the mating plane, the points on the fourth top edge of the second riser coincident with the mating plane defining a first line coplanar with the mating plane and parallel to the top member;

a first plurality of flexible fingers extending from the fourth top edge toward the mating plane and terminating at said first line;

a sidewall opening formed in the tapered sidewall of the tapered member at a location between the second top edge and the second bottom edge, the sidewall opening being bisected by the mating plane and defining a second port;

a third riser coaxially aligned with the sidewall opening in the tapered sidewall and having a fifth top edge and fifth bottom edge, the third riser having a second length from the fifth bottom edge to the fifth top edge which varies along a perimeter of the third riser, said second length having a maximum value for points on the fifth top edge of the third riser coincident with the mating plane and a minimum value for points on the fifth top edge of the third riser farthest from the mating plane, the points on the fifth top edge of the third riser coincident with the mating plane defining a second line coplanar with the mating plane and parallel to tapered sidewall;

a second plurality of flexible fingers extending from the fourth top edge toward the mating plane and terminating at said second line;

at least one first latch provided on the first sidewall at the mating plane on a first side of the enclosure;

a pair of second latches provided on opposite portions of the top member at the mating plane; and at least one hinge provided on the first sidewall at the mating plane on a second side of the enclosure opposite to the first side of the enclosure, wherein the at least one hinge includes at least two hinge posts supported by one of the first half-shell and the second half-shell and a cylindrical hinge pin supported by the other of the first half-shell and the second half-shell, each hinge post has a semi-arcuate engagement portion, and the at least two hinge posts are arranged such that the respective engagement portions are in an offset, opposing configuration so as to be able to rotatably embrace the hinge pin between the engagement portions.

* * * * *